US006211790B1

(12) United States Patent
Radomsky et al.

(10) Patent No.: US 6,211,790 B1
(45) Date of Patent: Apr. 3, 2001

(54) INFANT AND PARENT MATCHING AND SECURITY SYSTEM AND METHOD OF MATCHING INFANT AND PARENT

(75) Inventors: Israel Radomsky, Herzelia (IL); James L. Katz, Highland Park, IL (US); Shlomo Yasur, Tel Aviv (IL); Joesph Thomas Graceffa, Chicago; Peter Charles Simpson, Glencoe, both of IL (US)

(73) Assignee: ELPAS North America, Inc., Northbrook, IL (US)

( * ) Notice: Subject to any disclaimer, the term of this patent is extended or adjusted under 35 U.S.C. 154(b) by 0 days.

(21) Appl. No.: 09/314,814

(22) Filed: May 19, 1999

(51) Int. Cl.[7] ..... G08B 23/00
(52) U.S. Cl. ..... 340/573.4; 340/825.49
(58) Field of Search ..... 340/573.1, 573.4, 340/691.1, 691.4, 691.5, 692, 326, 331, 332, 386.02, 825.31, 825.32, 825.34, 825.49

(56) References Cited

U.S. PATENT DOCUMENTS

| | | | | |
|---|---|---|---|---|
| 3,603,881 | | 9/1971 | Thorton | 375/272 |
| 3,639,907 | | 2/1972 | Greatbatch | 340/870.09 |
| 3,872,448 | | 3/1975 | Mitchell, Jr. | 705/3 |
| 3,891,980 | | 6/1975 | Lewis et al. | 340/573.4 |
| 3,921,621 | | 11/1975 | Baessler | 600/549 |
| 3,946,159 | | 3/1976 | Fay | 348/8 |
| 3,972,320 | | 8/1976 | Kalman | 600/519 |
| 4,150,284 | | 4/1979 | Trenkler et al. | 600/473 |
| 4,151,407 | | 4/1979 | McBride et al. | 359/158 |
| 4,196,425 | | 4/1980 | Williams, Jr. et al. | 340/573.4 |
| 4,275,385 | | 6/1981 | White | 340/825.49 |
| 4,477,814 | | 10/1984 | Brumbaugh et al. | 343/725 |
| 4,694,284 | * | 9/1987 | Leveille et al. | 340/574 |
| 4,814,751 | | 3/1989 | Hawkins et al. | 340/573.1 |
| 4,853,692 | | 8/1989 | Wolk et al. | 340/573.1 |
| 4,906,853 | | 3/1990 | Linwood et al. | 250/551 |
| 4,952,913 | * | 8/1990 | Pauley et al. | 340/573.4 |
| 4,967,195 | | 10/1990 | Shipley | 340/825.52 |
| 4,977,619 | | 12/1990 | Crimmins | 455/607 |
| 4,990,892 | | 2/1991 | Guest et al. | 340/573.4 |
| 4,998,095 | | 3/1991 | Shields | 340/574 |
| 5,006,830 | | 4/1991 | Merritt | 340/573.1 |
| 5,014,040 | * | 5/1991 | Weaver et al. | 340/573.4 X |
| 5,017,794 | | 5/1991 | Linwood et al. | 250/551 |

(List continued on next page.)

FOREIGN PATENT DOCUMENTS

| | | |
|---|---|---|
| 0 586 230 | 3/1994 | (EP) . |
| 0 678 838 | 10/1995 | (EP) . |
| 0 717 380 | 6/1996 | (EP) . |
| 01617 | 1/1995 | (WO) . |

OTHER PUBLICATIONS

PCT Search Report for Application No. PCT/US00/14031 transmitted Sep. 11, 2000.

*Primary Examiner*—Thomas Mullen
(74) *Attorney, Agent, or Firm*—Marshall, O'Toole, Gerstein, Murray & Borun

(57) ABSTRACT

In one aspect of the invention, a dual-mode infrared/radio frequency (IR/RF) transmitter is secured within a wristband worn by the mother and within an ankle and/or wristband worn by the infant. In a matching mode of operation, IR signals are received by infrared receivers located within the various rooms of the hospital to precisely and automatically determine by proximity that mother and infant are correctly united. In a presence detecting mode, RF signals from the infant's badge are detected by RF receivers located throughout the maternity ward of the hospital or throughout the hospital generally. In a security mode, RF receivers located proximate exits of either of the maternity ward and/or the hospital detect RF signals from the ankle and provide a signal to generate an alarm.

62 Claims, 27 Drawing Sheets

U.S. PATENT DOCUMENTS

| | | | | |
|---|---|---|---|---|
| 5,027,314 | | 6/1991 | Linwood et al. | 701/300 |
| 5,047,750 | | 9/1991 | Hector | 340/573.4 |
| 5,079,541 | | 1/1992 | Moody | 340/573.4 |
| 5,119,104 | | 6/1992 | Heller | 342/450 |
| 5,142,396 | | 8/1992 | Divjak et al. | 359/142 |
| 5,218,344 | * | 6/1993 | Ricketts | 340/573.4 |
| 5,289,163 | | 2/1994 | Perez et al. | 340/539 |
| 5,291,399 | | 3/1994 | Chaco | 705/3 |
| 5,301,353 | * | 4/1994 | Borras et al. | 359/173 X |
| 5,317,309 | | 5/1994 | Vercellotti et al. | 340/10.5 |
| 5,319,363 | | 6/1994 | Welch et al. | 340/825.36 |
| 5,387,993 | | 2/1995 | Heller et al. | 359/155 |
| 5,396,224 | | 3/1995 | Dukes et al. | 340/825.49 |
| 5,426,425 | | 6/1995 | Conrad et al. | 340/825.49 |
| 5,440,295 | | 8/1995 | Ciecwisz et al. | 340/573.4 |
| 5,440,559 | * | 8/1995 | Gaskill | 370/314 |
| 5,455,851 | | 10/1995 | Chaco et al. | 379/38 |
| 5,457,440 | * | 10/1995 | Daddono | 340/573.4 |
| 5,458,123 | | 10/1995 | Unger | 600/509 |
| 5,504,474 | * | 4/1996 | Libman et al. | 340/573.4 |
| 5,512,879 | | 4/1996 | Stokes | 340/573.4 |
| 5,537,459 | | 7/1996 | Price et al. | 455/435 |
| 5,548,637 | | 8/1996 | Heller et al. | 379/201 |
| 5,572,195 | | 11/1996 | Heller et al. | 340/825.35 |
| 5,585,953 | | 12/1996 | Zavrel | 359/152 |
| 5,608,382 | | 3/1997 | Webb et al. | 340/573.4 |
| 5,610,589 | | 3/1997 | Evans et al. | 340/573.1 |
| 5,621,384 | | 4/1997 | Crimmins et al. | 340/539 |
| 5,627,524 | | 5/1997 | Fredrickson et al. | 340/825.07 |
| 5,640,147 | | 6/1997 | Chek et al. | 340/573.4 |
| 5,646,593 | | 7/1997 | Hughes et al. | 340/573.1 |
| 5,652,569 | | 7/1997 | Gerstenberger et al. | 340/573.4 |
| 5,661,460 | | 8/1997 | Sallen et al. | 340/573.4 |
| 5,661,471 | | 8/1997 | Kotlicki | 340/825.37 |
| 5,675,395 | | 10/1997 | Martin et al. | 348/734 |
| 5,689,229 | | 11/1997 | Chaco et al. | 340/286.07 |
| 5,714,932 | | 2/1998 | Castellon et al. | 340/539 |
| 5,742,238 | | 4/1998 | Fox | 340/825.49 |
| 5,745,037 | | 4/1998 | Guthrie et al. | 340/573.4 |
| 5,751,214 | | 5/1998 | Cowley et al. | 340/573.4 |
| 5,760,704 | | 6/1998 | Barton et al. | 340/825.49 |
| 5,767,791 | | 6/1998 | Stoop et al. | 340/870.11 |
| 5,808,551 | | 9/1998 | Yarnall, Jr. et al. | 340/573.4 |
| 5,838,223 | | 11/1998 | Gallant et al. | 340/286.07 |
| 5,917,425 | * | 6/1999 | Crimmins et al. | 340/825.49 |

* cited by examiner

IR/RF Modulation Scheme (ASK OOK)

IR TX FROM BDG
DECODED IR RX IN RDR
BDG RX WINDOW
RDR TX ACK TO RDR
DECODED ACK RX IN BDG
RF TX FROM BDG
t1-t2 SEC
900
902
902
906
904
905
908
tP
IR TX FROM BDG NOT RX BY RDR
tWIN
tα

BUTTON PRESS
WIRE CUT
TRANSMISSIONS (WITH MODIFIED CODE) IN CASE OF BUTTON PRESS OR WIRE CUT
IN CASE OF WIRE CUT MODIFIED CODE
t3 SEC
tpMS
IR TX
td SEC
EVERY t4 SEC
EVERY t4 SEC
tpMS
RF TX

INFANT AND PARENT MATCHING AND SECURITY SYSTEM AND METHOD OF MATCHING INFANT AND PARENT

BACKGROUND OF THE INVENTION

1. Field of the Invention

The invention relates generally to security systems, and more particularly, the invention relates to a system for automatically verifying that a newborn infant is correctly matched with its parents and for ensuring the security of the newborn infant within a hospital.

2. Description of the Related Technology

The abduction of infants from hospital maternity wards happens with alarming frequency. The incorrect matching of newborn infants and parents also occurs much too often. That either of these events occur at all is unacceptable, particularly if it is your baby.

To ensure that mother and infant are correctly matched together, hospitals presently use a system of coded badges that are secured to each of the mother and the infant. Typically, a multi-digit code is printed on a wristband which is secured to the mother, and a wrist and/or ankle band bearing a matching multi-digit code is secured to the infant. The mother's badge is secured prior to delivery, and the infant's badges are secured as soon as practical after delivery while both the mother and infant remain in the delivery room. When mother and infant are later united, for example when the infant is brought from the nursery to the mother's recovery room, a hospital staff member is instructed to verify the numbers match to ensure the correct infant is united with the correct mother. Mothers are also encouraged to check that the numbers match. As an alternative to the infant wrist or ankle band, it has been proposed to imprint the code on an umbilical clamp and to provide the mother with a wristband again bearing a matching code. It is suggested that the umbilical clamp system ensures that the coded band does not inadvertently detach itself from the infant. With either wrist/ankle bands or umbilical clamps, the system requires human intervention to function correctly, and errors in matching mother and infant can still occur if the hospital staff or the mother fail to check or are careless in checking that the coded numbers match.

In spite of the care exercised by the hospital staff, the mismatching of mothers and infants continues to happen. The problem lies with the fact that there is no backup for the possibility of human error. For example, if an error is made when the infant is brought to its mother before discharge, it is possible that the mother may leave the hospital with the wrong infant before the error is detected. Furthermore, there is no positive feedback to either the mother or the hospital staff person making the matching verification that they have in fact correctly observed and matched the multi-digit numbers.

Infant abduction from hospital maternity wards it is sad to say is a growing problem. To combat such abductions, it has been proposed to provide radio frequency transmitters within the wrist or ankle band secured to the infant. Alternatively, magnetic strips or similar remotely excited circuits or materials may be placed within the wrist or ankle band. In still other proposed arrangements, the transmission device is secured within an umbilical clamp. Radio frequency receivers are positioned near exits from either the maternity ward and/or the hospital, and an alarm is sounded should an infant, wearing a transmission capable badge, be brought into proximity with the receiver.

To be effective, the radio frequency signals generated in the wrist and/or ankle bands have to be transmitted with sufficient strength to ensure that the infant is detected within the maternity ward and/or to ensure detection at the exit. However, transmitting the signals with increased power, i.e., such that they have sufficient signal strength to ensure detection, severely limits their usefulness for precisely locating the infant. This is because radio frequency signals will penetrate and pass through walls, floors, ceilings, and various other substantially non-conductive boundaries. So, while a radio receiver may be located in a room separate from where the infant is actually located, it may still be very much capable of receiving the signal from the infant's badge. In fact, the infant may be located in different rooms, on different floors, or outside of the hospital entirely. Therefore, it is impractical to use the radio frequency signals to locate the infant within the hospital. It has been suggested that relative signal strength indications (RSSI) along with triangulation may be used to better identify the location of a RF transmitter in a hospital application. However, RSSI value is greatly influenced by a number of factors including multi-path, Rayleigh fading, interference, and the like, limiting its effectiveness when used alone for identifying the precise location of the transmitter.

RF systems utilizing magnetic strips or other remotely excited circuits rely on detection of a resonant signal generated within the badge in response to an excitation signal to detect the presence of the badge near the reader. Unfortunately, these systems require the badge to be placed in close proximity and with proper orientation to the reader to be effectively energized and read. These systems fail as the badge can not always be in close proximity to a reader during matching of infant and mother. As precise location information is required to ensure proper matching of infant and mother, these RF systems are not viable for providing a matching function.

Infrared (IR) transmitters and receivers are commonly used in the hospital environment to locate equipment and personnel. The advantage of using IR signals for providing location information is that the IR signals do not penetrate walls, floors, ceilings or other substantially opaque boundaries. Thus, by locating an IR receiver in each room of the hospital, it is possible to know precisely which room within the hospital the transmitting device is located. Infrared signals, however, are easily blocked. If the transmitting device is disposed within a wristband or ankle band secured to an infant, and certainly within an umbilical clamp, it is likely that the signals will be blocked by clothing or blankets in which the infant is wrapped. Thus, IR technology, while offering the promise of providing precise location, does not provide the assured detection required for security purposes.

Thus, there is a need for a system which offers the capability to precisely locate both mother and infant within the hospital and to provide an indication that mother and infant are correctly matched. Additionally, the system must further have the capability to detect the presence of the infant within the hospital and to detect the attempted unauthorized removal of the infant from the maternity ward and/or the hospital.

SUMMARY OF THE INVENTION

A system in accordance with the preferred embodiments of the invention 1) ensures mother and infant are correctly matched postpartum, 2) continuously monitors the presence of the infant within the hospital and particularly within the hospital maternity ward, and 3) detects and signals the unauthorized removal of the infant from either the hospital maternity ward and/or the hospital entirely.

In one aspect of the invention, a dual-mode infrared/radio frequency (IR/RF) transmitter is secured within a wristband worn by the mother and within an ankle band and/or wristband worn by the infant. In a matching mode of operation, IR signals are received by infrared receivers located at various locations in and around the hospital to precisely and automatically determine by proximity that mother and infant are correctly united. In a presence detecting mode, RF signals from the infant's badge are detected by RF receivers located throughout the maternity ward of the hospital or throughout the hospital generally. In a security mode, RF receivers located proximate exits of either of the maternity ward and/or the hospital detect RF signals from the ankle band and/or wristband and provide a signal to generate an alarm.

In another aspect of the invention, an IR receiver and an RF receiver may be integrated into a single unit.

Another feature of the invention provides for an audio and/or visual signal for providing an indication mother and infant are correctly matched.

In still another aspect of the invention, each of the mother's wristband and the infant's badge are capable of providing an indication that mother and infant are correctly matched.

In yet another aspect of the invention, each of the IR signals and the radio frequency signals have a common modulation and are distinguished to the receiver by a header message.

In another aspect of the invention, the mother's wristband and/or the infant's ankle band include a motion sensor and capability of modifying its transmitted signal should it fail to detect motion associated with being secured to the mother or infant.

Still an additional aspect of the invention provides for each of the IR and RF signals to be sent in short bursts randomly distributed within a larger window of time.

An additional feature of the invention permits simultaneous use of numerous ankle bands within a single nursery without mutually interfering.

Another aspect of the invention provides packaged, ready to use dual-mode wristbands and/or ankle bands in sets to be matched upon initialization within the birthing room.

BRIEF DESCRIPTION OF THE DRAWINGS

These and the many other advantages and features of the invention will become apparent to those skilled in the art from the follow detailed description of several preferred embodiments read in conjunction with the attached figures wherein like reference numerals are used to represent like elements throughout and in which.

DETAILED DESCRIPTION OF THE PREFERRED EMBODIMENTS

Figure 1:
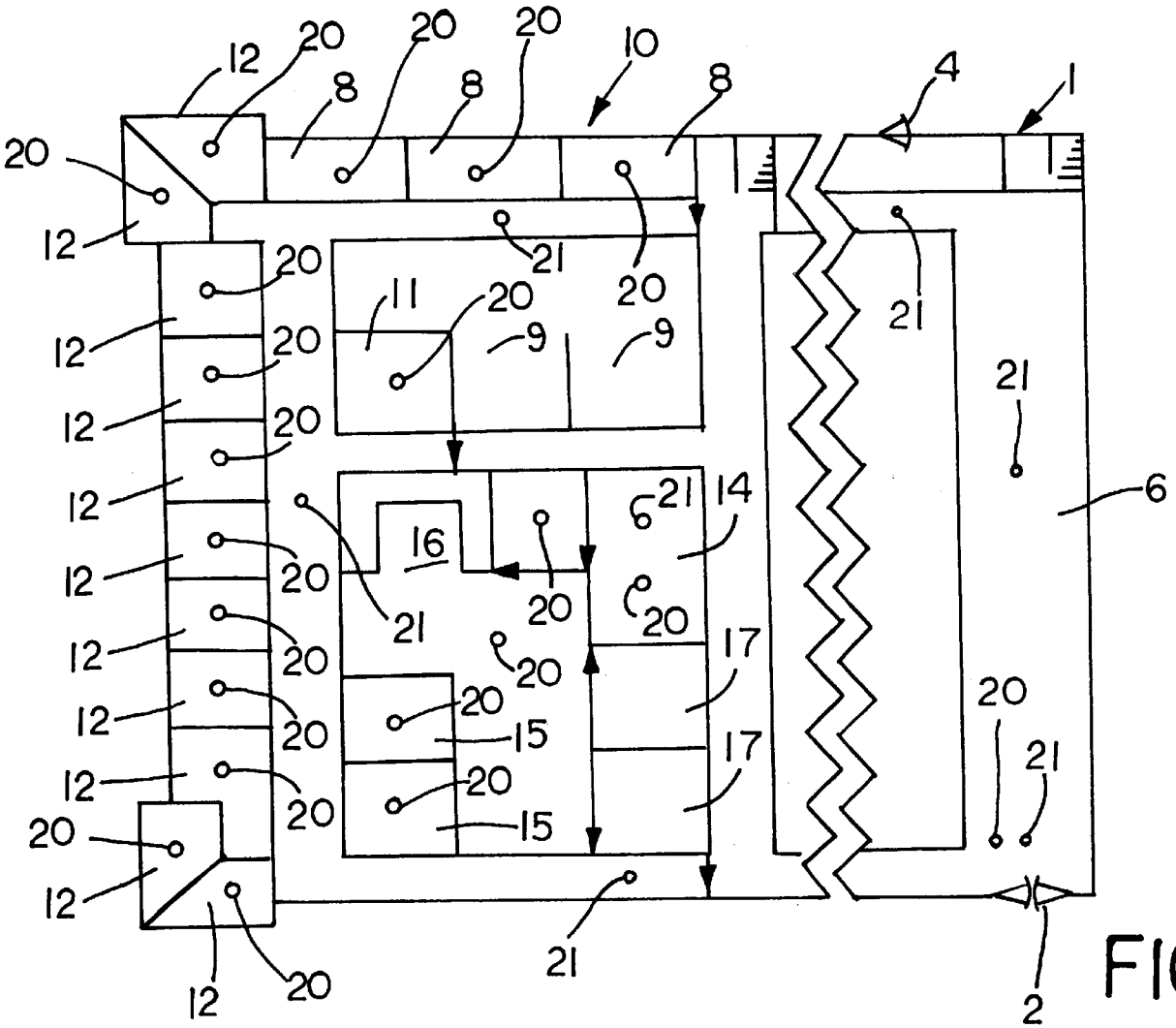
FIG. 1 is a schematic illustration of a hospital including a hospital maternity ward equipped with an infant and parent matching and security system in accordance with a preferred embodiment of the invention.

With reference now to FIG. 1, within a hospital 1, a hospital maternity ward 10, includes a plurality of patient rooms 12 in proximity to Cesarian delivery rooms 8, delivery rooms 9, delivery staging area 11, nursery 14, care service station 16, recovery rooms 15, staff locker rooms 17, and emergency care area 18. Of course the invention has application to any hospital and/or maternity ward layout, and is further adaptable to associated neo-natal intensive care rooms, operating rooms and other portions of the hospital associated with the delivery and care of pre- and post-partum mothers and newborn infants. Still further, one of ordinary skill in the art will appreciate the applicability of the invention in other matching/security applications generally for persons or objects.

Figure 2:
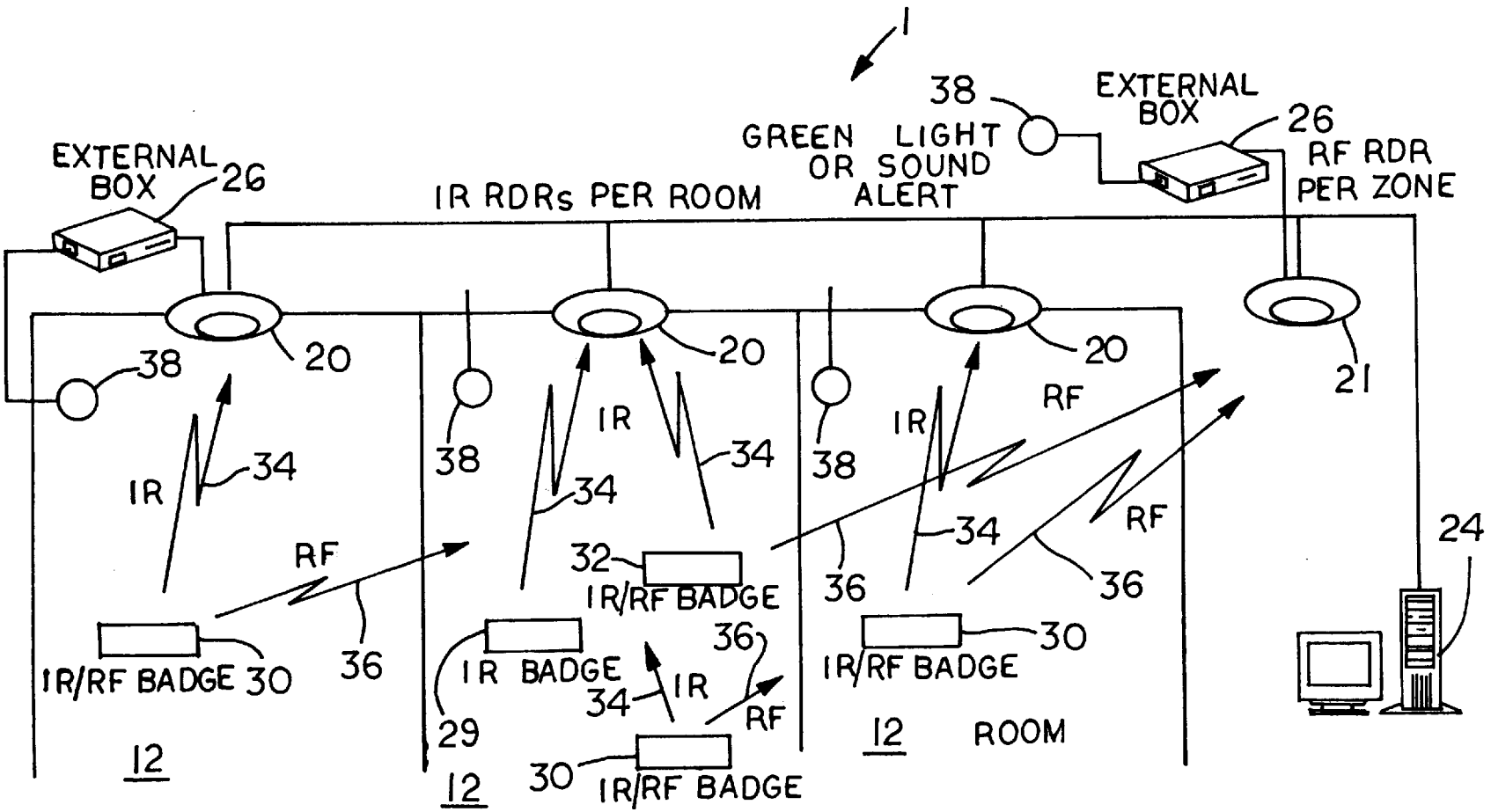
FIG. 2 is a block diagram illustration of an infant and parent matching and security system in accordance with a preferred embodiment of the invention.

In accordance with the preferred embodiments for the invention, and with continued reference to FIG. 1 and with reference to FIG. 2, each patient room 12 is fitted with an infrared (IR) signal reader (referred to herein as IR reader 20). An additional IR reader 20 is located within staging area 11, nursery 14, recovery rooms 15, near care service station 16 and emergency care area 18. At various other locations of the ward 10, and particularly within common areas, hallways and near exits 11 from the ward 10 there is fitted a radio-frequency (RF) reader 21. Additionally, and as best seen in FIG. 1, one or more IR readers 20 and RF readers 21 may be positioned near hospital entrance 2, hospital secondary entrance and exit 4 or generally along the hallways 6 of the hospital 1.

Referring still to FIG. 2, each IR reader 20 and RF reader 21 is coupled, preferably via a LonTalk network 22, to a central server 24. Further coupled to the network 22 adjacent central server 24 is an input/output station (not depicted). Optionally coupled to either IR reader 20 or RF reader 21 is an external device controller 26. Each external device controller 26 is adapted to provide control signals to external devices, such as lighting systems, heating/ventilation controls, and the like. More preferably, the external device controller 26 permits coupling to an audio or visual alert device 38 capable of providing visual and audio indications of the correct or incorrect matching of a parent and infant and the unauthorized removal of an infant from a secured area. However, the alert devices may be coupled directly to network 22 as shown by alert devices 38'. An audio or visual alert device 38 or 38' is positioned within each patient room 12. Each display device 38 may be a scrolling text display, a light display, or virtually any suitable display device. For example, the patient's in-room television may be adapted to act as the display. Display device 38 may also include audio capability allowing the sounding of voice signals, tunes and alert tones.

Upon admission to the hospital, the expecting mother is provided with a mother identification badge (referred to herein as mother badge 30), which is operable to provide both an IR identification signal 34 and a RF identification signal 36. Authorized persons, such as nurses, are issued badges 29 that may provide both an IR identification signal and a RF identification signal, but more typically provide only IR signals. The following discussion with respect to the mother badge 30 is applicable to such authorized persons badges 29. In accordance with the invention, each badge 30 is matched to one or more infant identification badges (referred to herein as infant badge 32). By saying each mother badge 30 is matched to one or more infant badges 32, each mother badge 30 and infant badge 32 is operable to provide both an IR identification signal 34 and a RF identification signal 36 containing identification information. Preferably, within server 20, the identification information from the mother badge 30 is mapped to identification information for the infant badge 32 within a central database contained within server 20. Alternatively, each of the mother badge 30 and the infant badge 32 may be programmed such that each of the badge's identification information contains matching data. While an authorized person is not, per se, matched with an infant, identification of the authorized person is used in the invention to permit that person to move an infant between rooms within ward 10 or to remove an infant entirely from ward 10.

In accordance with the invention, the IR reader 20 in each patient room 12 receives the IR identification signals 34 from each mother badge 30 and infant badge 32 located within the patient room 12. Because IR transmission will not penetrate opaque surfaces, such as walls, doors, floors and ceilings, the IR identification signals 34 are substantially confined to within the particular patient room 12. The RF identification signals are capable of penetrating opaque but non-conducting surfaces, and the RF readers 21 receive the RF identification signals from each mother badge 30 and infant badge 32 located within a reception range of the RF reader 21. Thus, the RF readers 21 receive the RF identification signals from each mother badge 30 and each infant badge 32 located within the ward 10. The RF readers 21 further receive identification signals from badges located in other but nearby locations of the hospital.

The server 24 may be a standalone server for use with the infant security and monitoring system, or may be implemented as part of a hospital security system or other building information management system which is advantageously facilitated by use of the LonTalk network architecture for network 22. In a standalone application, server 24 is at least coupled to communicate with the hospital security system. Server 24 is preferably implemented using a multi-purpose computer such as an Intel processor based personal computer running the Windows operating environment. It will be appreciated, however, that various other multi-purpose computing platforms may be used to implement server 24. Each input/output station 28 permits access to server 24 for observing the operation and status of the system 1.

Each IR reader 20 also includes local processing capability. Local processing capability allows each IR reader 20 to provide decoding and processing of the received IR identification signals 34. Each RF reader 21 also includes similar processing capability and the following discussion is equally applicable thereto. In accordance with a preferred embodiment of the invention, each IR reader 20 may therefore be operable to determine if both a mother badge 30 and an infant badge 32 transmitting matching identification information are within the reception range of the IR reader 20. With a mother and an infant located within a patient room 12, and upon initiation of a matching process, the IR reader 20 within the patient room 12 receives and decodes the identification information from each of the mother badge 30 and the infant badge 32, providing each badge is optically exposed to the IR reader 20, and provides a signal indicating mother and infant have been correctly matched together.

In a preferred embodiment, each display device 38 is operable to provide visual messages, such as scrolling text and/or flashing lights. For example, upon detection of the correct matching of a mother and infant, the mother's and infant's names may be scrolled across the display in a first color, such as green. If an incorrect match is detected, a message as well as the identification of the mother's and infant's names may be scrolled in a different color, such as red, to indicate the incorrect matching. The message may also be flashed to draw further attention to the incorrect matching. Display devices 38 may also include audio capability to play speech segments, tunes, alert tones, and the like in connection with the matching process. In addition, each IR reader 20 may also include an indicator lamp. The indicator lamp may illuminate if a correct match is made or may flash during the matching process indicating system operation. IR reader 20 further provides a signal to server 24 via network 22, and the database within server 24 is then updated with the present locations of both the mother and the infant.

Figure 3:
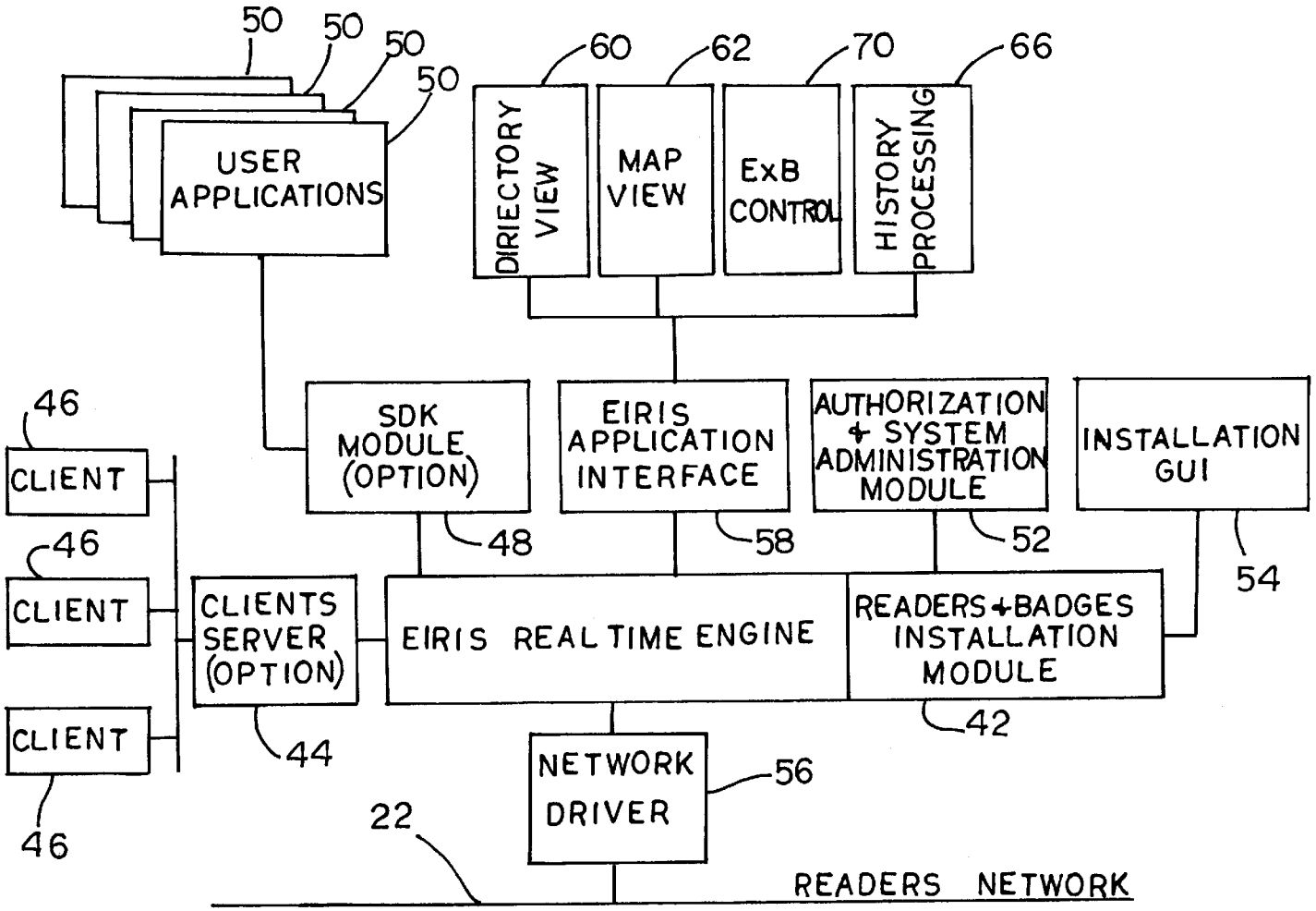
FIG. 3 is a block diagram of a hospital information management system incorporating an infant and parent matching and security system in accordance with the invention.

Referring now to FIG. 3, the functional elements of server 24 are illustrated. Central to server 24 is a real time engine 40 having directly coupled thereto an installation module 42 and which is linked to a client server driver 44. The client server driver 44 is an optional element which supports the addition of client stations 46 from server 24 and may be an ethernet driver or similar networking device. An additional optional element is a user applications module 48 supporting a plurality of user applications 50. User applications 50 may include links to other hospital systems, external system access, Internet access, and similar type applications. Two additional modules include a systems administration module 52 and installation interface 54. Administration module 52 permits access to engine 40 for administering the database contained therein and/or otherwise modifying the operating parameters of system 1.

With continued reference to FIG. 3, engine 40 is operatively coupled to network 22 via a network interface driver 56. Driver 56 is preferably a LonTalk network driver coupling engine 40 to network 22. Also provided is a system application interface 58 operatively coupling to a plurality of system applications 60–70. Directory view 60 and map view 62 provides directory listing of hospital personnel and patients and graphical display of maternity ward 10, respectively. History processor 66 and external device control 70 are optional modules. If network 22 includes external device controllers 26, commands are to these controllers are processed through external device control 70 and messaged via network 22 to the appropriate external device controller 26. History processor 66 is operable to maintain a running history of system operation and to record this history in an appropriate database associated with the system.

Figure 4A:
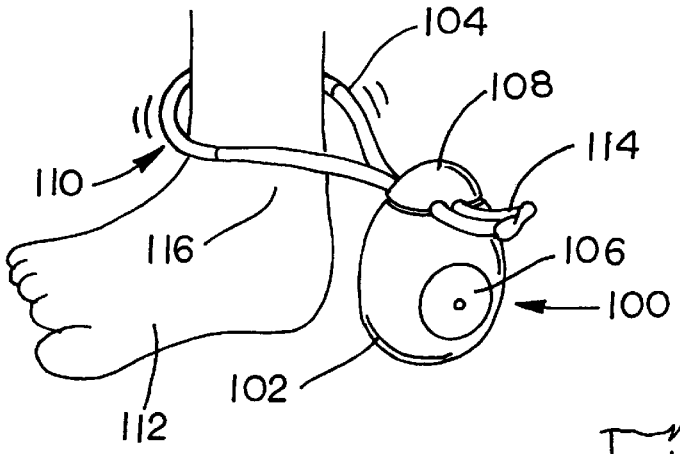
FIGS. 4*a*–4*c* illustrate in perspective an infant dual IR/RF badge in accordance with a preferred embodiment of the present invention being attached to an infant.
Figure 4B:
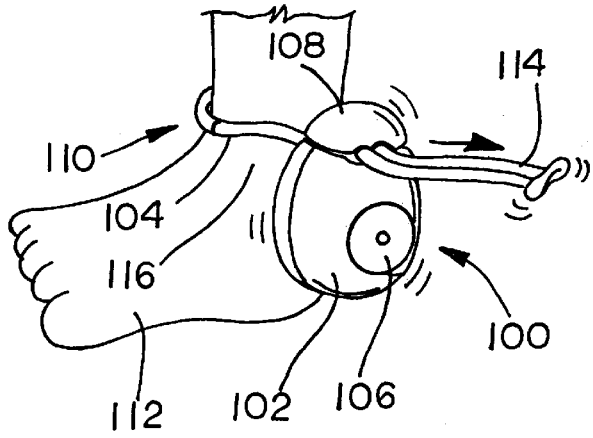
Figure 4C:
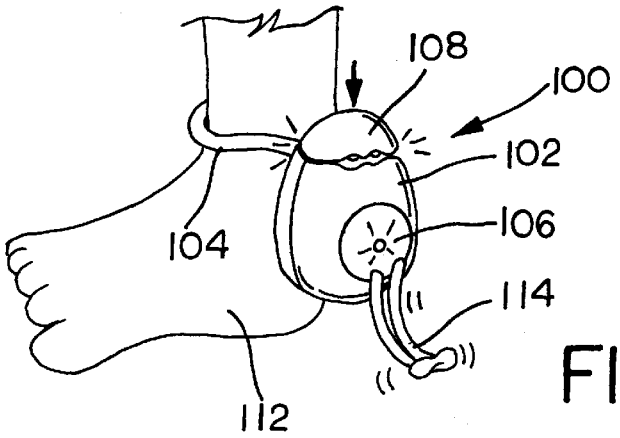
Figure 5:
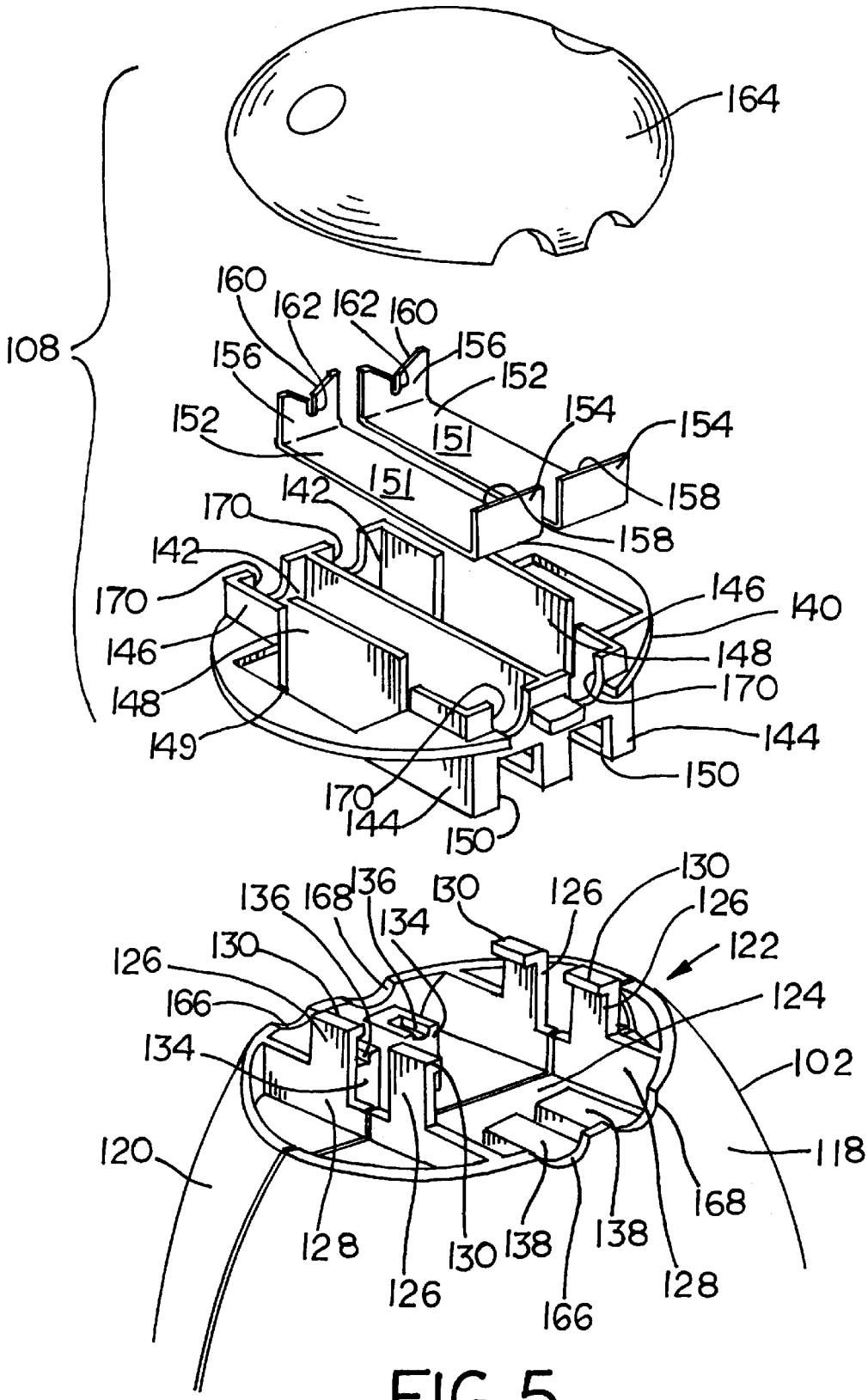
FIG. 5 is an exploded assembly perspective of the infant dual IR/RF badge illustrated in FIGS. 4*a*–4*c;*

With reference now to FIGS. 4*a*–4*c*, an infant badge 100 in accordance with a preferred embodiment of the invention for use with system 1 includes a housing 102, a strap 104, a lens 106 and a strap coupling 108. Housing 102 is preferably a stylized oval or egg shaped member formed of plastic or plastic coated with an elastomer to provide a soft, non-abrasive surface. Strap 104 is preferably formed from an elastomer, and while shown as a round cord, may have a flattened configuration with rounded portions extending through strap coupling 108. In addition, strap 104 further includes embedded therein at least one conductor, which preferably comprises braided copper wire. Initial strap 104 is pre-looped through strap coupling 108 forming a loop 110 sufficiently large to easily secure over a foot 112 or hand of an infant. The ends 114 of strap 104 may be joined to prevent them from become disengaged from strap coupling 108. Lens 106 is preferably formed from an IR transparent plastic.

Referring to FIG. 4*b*, with loop 110 positioned over foot 112, ends 114 are drawn through strap coupling 108 snugging strap 104 around the infant's lower leg 116. With strap 104 snug, but not too tight, strap coupling 108 is depressed with respect to housing 102, cutting ends 114 and activating infant badge 100, FIG. 4*c*.

With attention directed to FIGS. 5–8, housing 102 is formed from a first housing 118 and a second housing 120, sonically welded, bonded or otherwise secured together. At a strap interface portion 122, housing 102 forms a generally cylindrical cavity 124 from which a plurality of upwardly (as viewed in FIG. 5) extending flanges 126 extend from ribs 128 formed within cavity 124. Each flange 126 includes an inwardly extending tab 130. Further formed within cavity 124 is a pair of contact members 132. Each contact member 132 includes a substantially rectangular boss portion 134 extending upwardly from cavity and a metalized contact portion 136 which couples to a transmitter (not shown in FIG. 5) retained within housing 102. A second pair of bosses 138 are formed in cavity 124 opposite but substantially aligned with contact members 132. Each boss 138 also has a generally rectangular shape extending upwardly from within cavity 124.

Formed as a separate assembly is strap coupling 108. Strap coupling 108 has a circular base 140 formed with two contact cavities 142 each having a portion 144 extending below circular base 140 and a portion 146 extending above base 140. Each portion 144 is formed with two apertures 150 sized to receive a respective contact member 132 and boss 138. On an outer wall 146 of each cavity 142 is a flange 148 adjacent an aperture 149 formed in base 140. Aperture 149 is sized to provide clearance for flanges 126. Disposed within each contact cavity 142 is an insulation displacement contact/cutter (IDC) 152. Each IDC 152 has a horizontally extending plate member 151 formed with upwardly extending leg portions 154 and 156 at opposite ends thereof Each leg portion 154 includes a cutting edge 158 for engaging and cutting a portion of strap 104. Each leg portion 156 is formed with a "V" shaped channel 160 including a wire notch 162 at its base. A cover 164 is provided which is sonically welded, bonded, or otherwise secured to base 140 enclosing each IDC 152 in a respective contact cavity 144.

Figure 6:
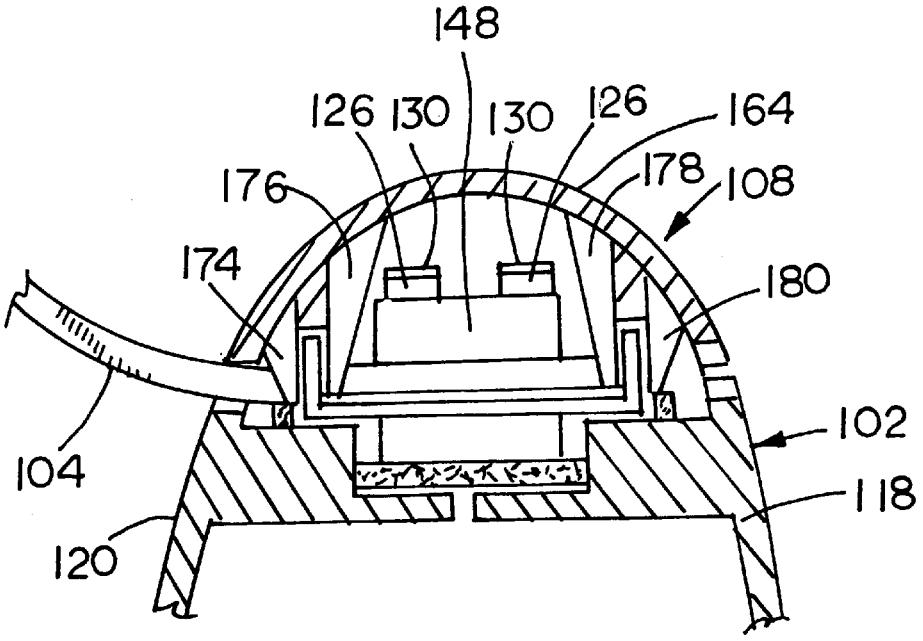
FIG. 6 is a cross-section view taken along line 6—6 of FIG. 4*a* and with the infant dual IR/RF badge in an open position.
Figure 7:
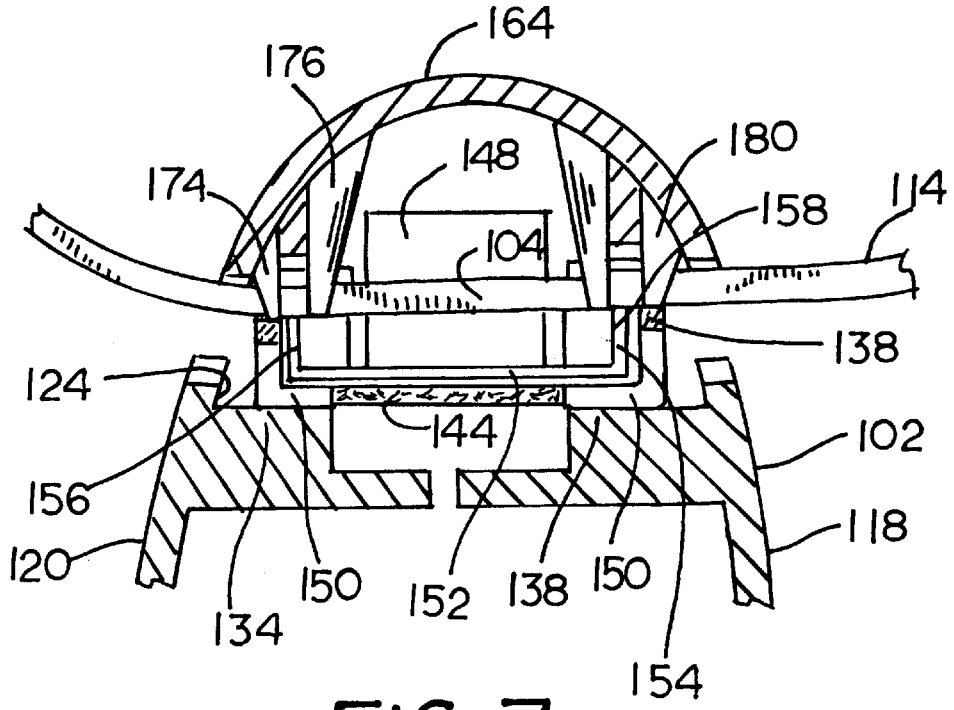
FIG. 7 is a cross-section view taken along line 7—7 of FIG. 4*c* and with the infant dual IR/RF badge in a closed position.
Figure 8:
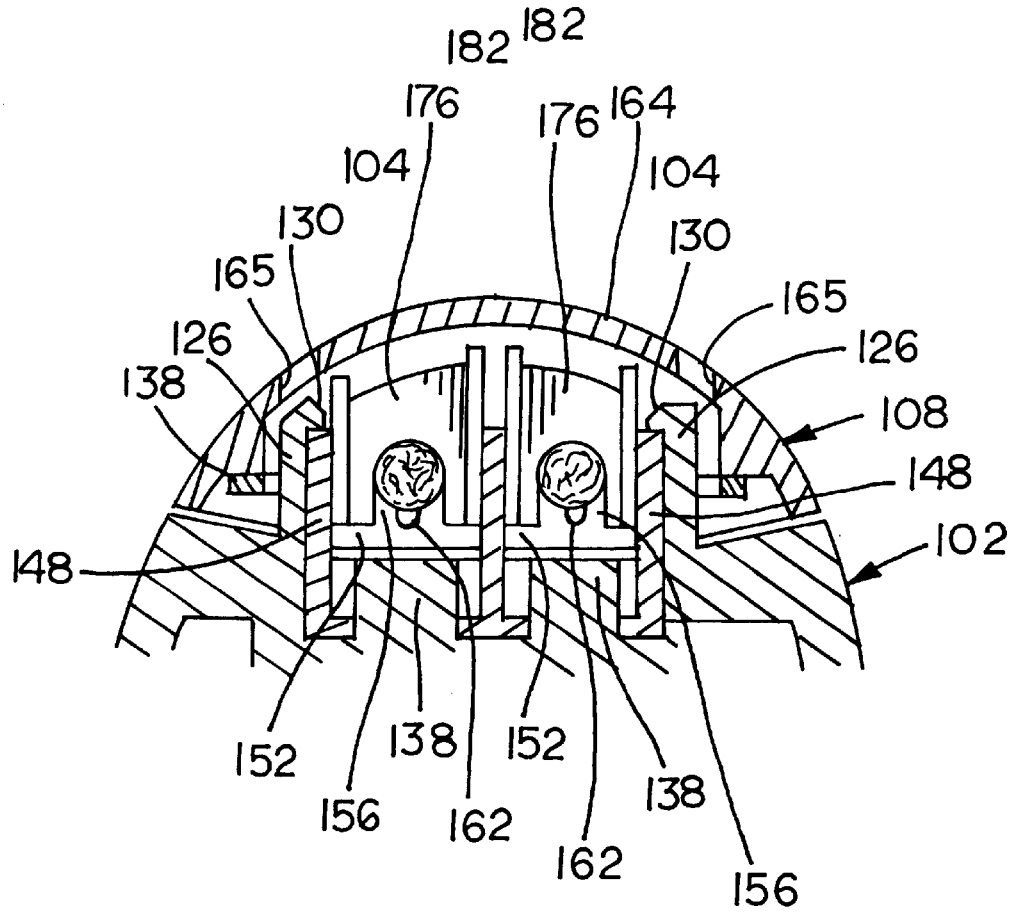
FIG. 8 is a cross-section view taken along line 8—8 of FIG. 4*c;*

With particular reference to FIGS. 6–8, strap 104 is captured between base 138 and cover 164. A first portion is disposed in recesses 166 and a second portion is disposed in recesses 168 formed in base 140. Cover 164 is further formed with downwardly extending flanges 174–180 that also include recesses, shown as recesses 170 and 172 in FIG. 8, and strap 104 is further received therethrough.

As shown in FIG. 6, base 140 is positioned over cavity 124 and apertures 150 are aligned with contact members 132 and bosses 138. As strap coupling 108 is pressed downward, FIGS. 7 and 8, contact members 132 and bosses 138 pass through apertures 150 and bear against a bottom surface of IDCs 152. Flanges 176–180 press strap 104 downwardly against IDCs 152. Edge 158 severs ends 114. In addition, strap 104 is engaged in "V" 160 which displaces the outer elastomer portion of strap 104 and engages the conductor 182 into wire notch 162. Conductor 182 is coupled to IDCs 152 which in turn is coupled by contacts 136 with the transmitter portions disposed within housing 102. As will be described more fully herein below, coupling of strap 104 with the transmitter portion activates infant badge 100 and further permits detection of tampering with badge 100. Strap coupling 108 is retained to housing 102 by the engagement of tabs 130 with flanges 148. Strap coupling 108 may be removed from housing 102 by accessing tabs 130 via apertures 165 formed in cover 164.

Figure 9A:
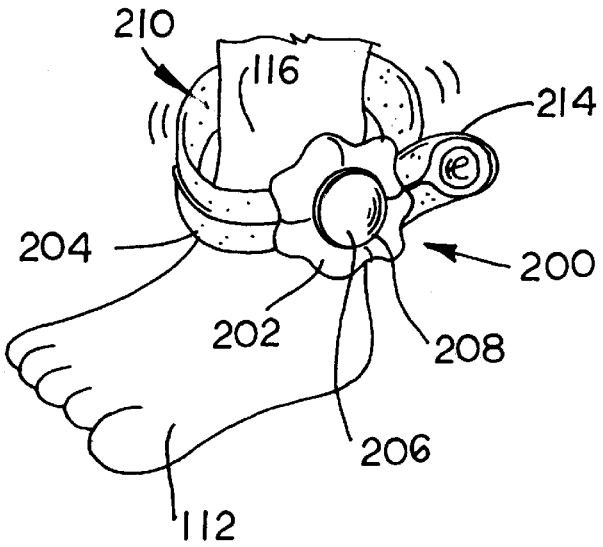
FIGS. 9*a*–9*c* illustrate in perspective an infant dual IR/RF band in accordance with an alternate preferred embodiment of the present invention being attached to an infant.
Figure 9B:
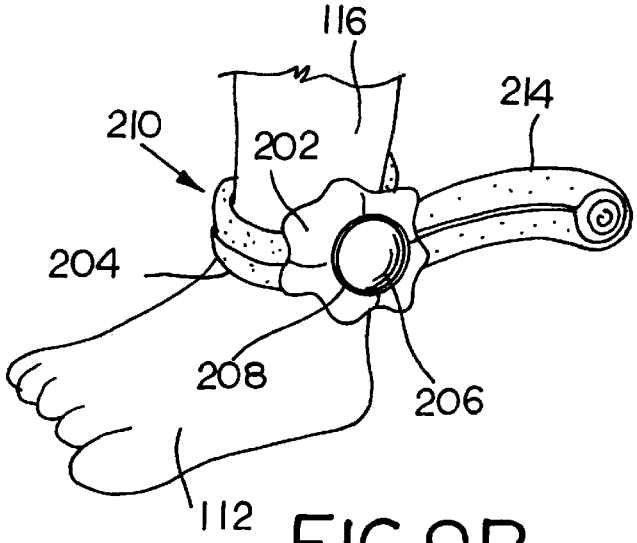
Figure 9C:
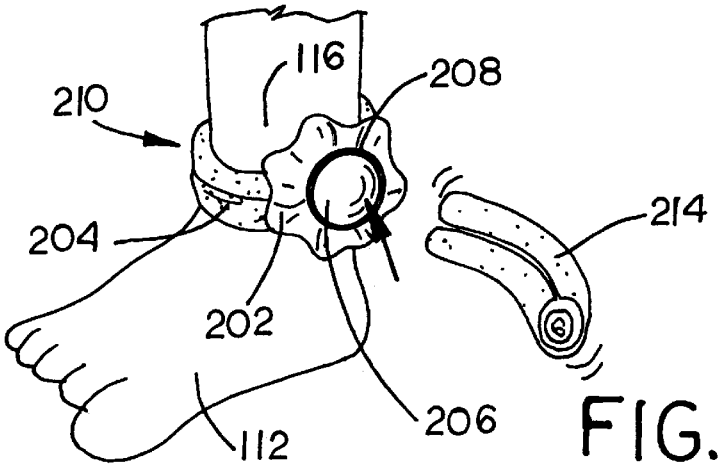

Referring now to FIGS. 9*a*–9*c* an infant badge 200 in accordance with an alternative preferred embodiment of the invention is shown. Infant badge 200 includes a housing 202, a strap 204, and a strap coupling 208 including a lens 206. Housing 202 preferably has a stylized flower shape with strap coupling 208 forming a central portion thereof. Housing 202 is preferably formed of plastic or plastic coated with an elastomer to provide a soft, non-abrasive surface. Strap 204 is preferably formed from an elastomer having a flattened configuration with a portion extending through strap coupling 208 In addition, strap 204 further includes embedded therein at least one conductor, which preferably comprises braided copper wire. Initially strap 204 is pre-looped through strap coupling 208 forming a loop 210 sufficiently large to easily secure over a foot 112 or hand of an infant.

Referring to FIG. 9*b,* with loop 210 positioned over foot 112, end 214 is drawn through strap coupling 208 snugging strap 204 around the infant's lower leg 116. With strap 204 snug, but not too tight, strap coupling 208 is depressed with respect to housing 202, cutting ends 214 and activating infant badge 200, FIG. 9*c*.

Figure 10A:
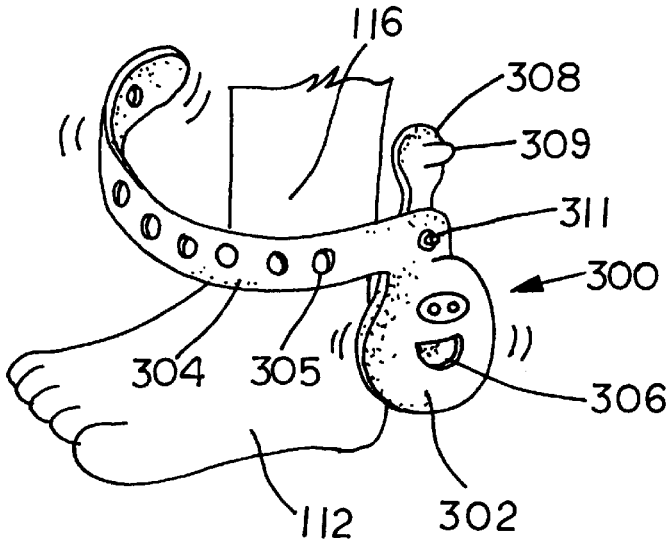
FIGS. 10*a*–10*c* illustrate in perspective an infant dual IR/RF badge in accordance with an alternate preferred embodiment of the present invention being attached to an infant.
Figure 10B:
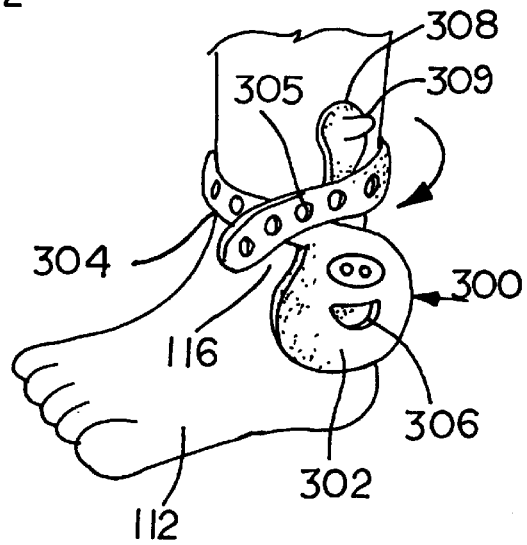
Figure 10C:
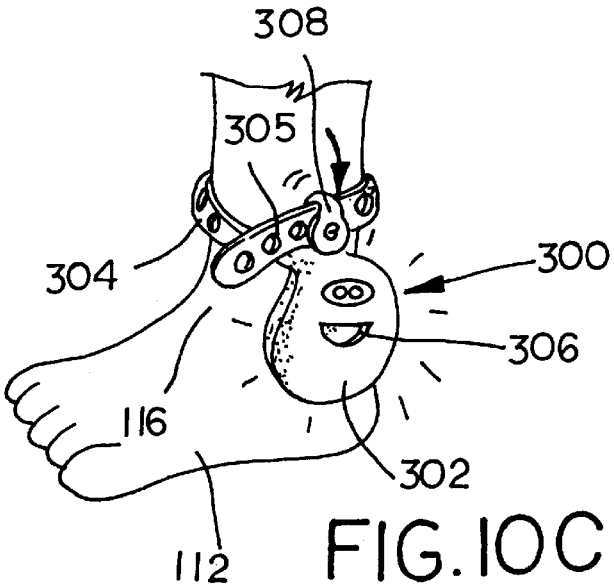

Referring now to FIGS. 10*a*–10*c* an infant badge 300 in accordance with an alternative preferred embodiment of the invention is shown. Infant badge 300 includes a housing 302, a strap 304, a lens 306 and a strap coupling 308. Housing 302 is preferably disk shaped with strap coupling 308 extending from a rear portion thereof. Housing 302 is preferably formed of plastic or plastic coated with an elastomer to provide a soft, non-abrasive surface. Strap 304 is preferably formed from an elastomer having a flattened configuration formed with a plurality of apertures, one of which is shown as 305. Strap coupling 308 includes a pin 309 adapted to engage one of the plurality of apertures 305 with a portion extending through strap 304 and into a locking aperture 311 formed adjacent housing 302. Strap 304 further includes embedded therein at least one conductor, which preferably comprises braided copper wire and a portion which bridges each of the plurality of apertures.

Referring to FIG. 10*b,* strap 304 is positioned around lower leg 116 forming a loop 310. One of the plurality of apertures 305 is aligned with the locking aperture 311, and pin 309 is engaged with the aperture 305 and locking aperture 311. Pin 309 engages the conductor within strap 304 activating badge 300 shown in FIG. 10*c*. An end 314 of strap 304 may then be trimmed using scissors.

Figure 11A:
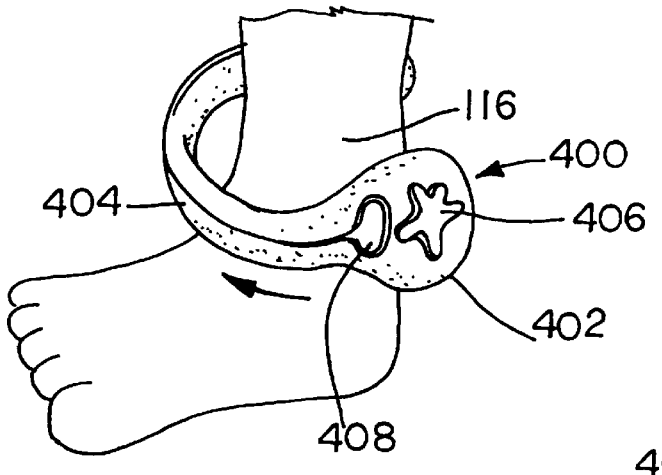
FIGS. 11*a*–11*c* illustrate in perspective an infant dual IR/RF badge in accordance with an alternate preferred embodiment of the present invention being attached to an infant.
Figure 11B:
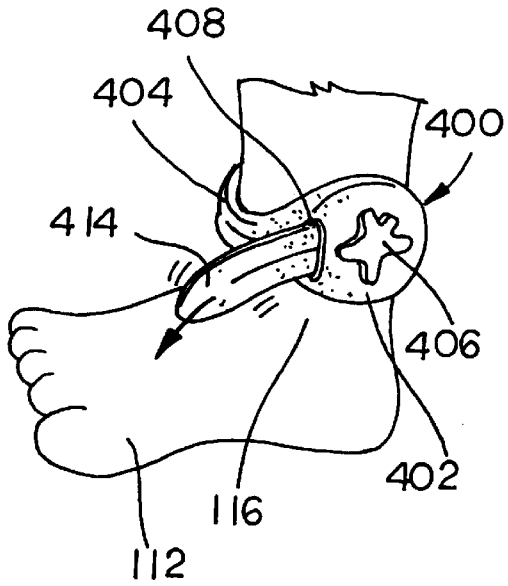

With reference now to FIGS. 11*a*–11*b,* an infant badge 400 in accordance with still an additional preferred embodiment of the invention for use with system 1 includes a housing 402, a strap 404, a lens 406. A strap coupling is provided and integrated into housing 402 and is actuated by depressing lens 406. Housing 402 preferably has a rounded shape formed of plastic or plastic coated with an elastomer to provide a soft, non-abrasive surface. Strap 404 is preferably formed from an elastomer having a flattened configuration and adapted to extend through housing 402, and hence through the integrated strap coupling. In addition, strap 404 further includes embedded therein at least one conductor, which preferably comprises braided copper wire.

Figure 11C:
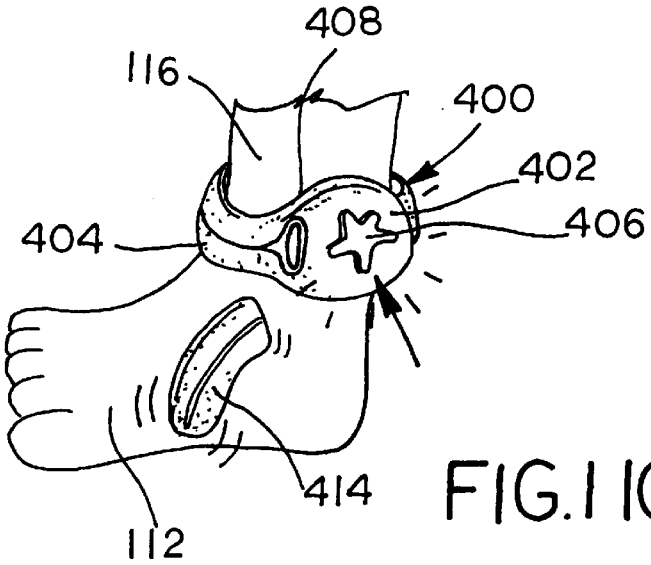

Referring to FIG. 11*b,* strap 404 is looped through an aperture 408 in housing 404 forming a loop 410 around the infant's lower leg 116 and thereby position strap within the integrated strap coupling. With strap 404 snug, but not too tight, strap coupling is actuated by depressing lens 406 with respect to housing 402. This action cuts end 414 and activates infant badge 400, FIG. 11*c*.

Figure 14:
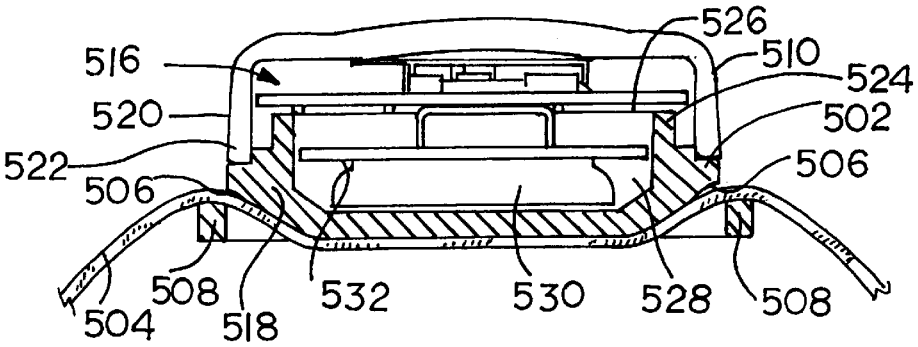
FIG. 14 is a cross-section view taken along line 14—14 of FIG. 13.
Figure 13:
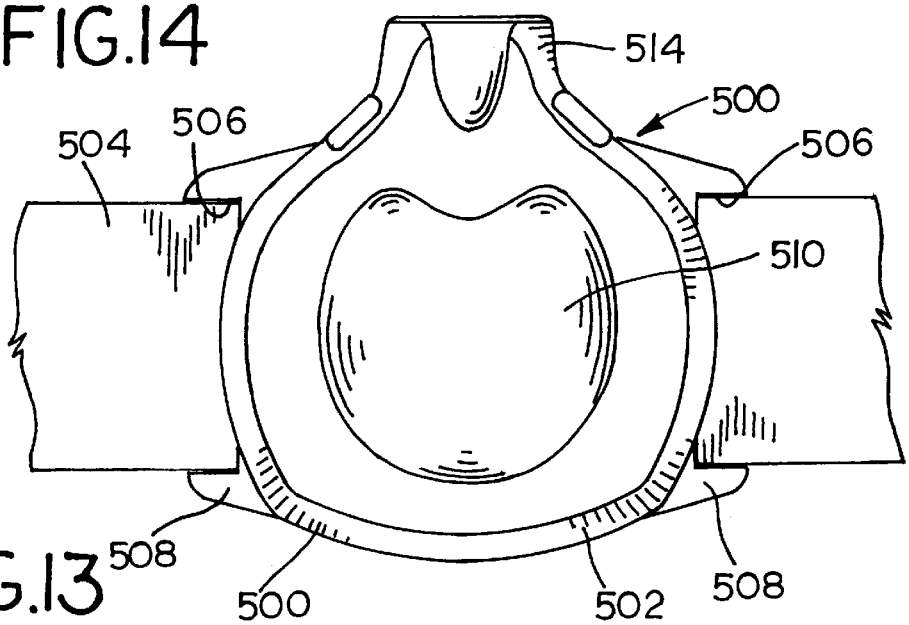
FIG. 13 is a plan view of the parent dual IR/RF badge shown in FIG. 12.
Figure 12:
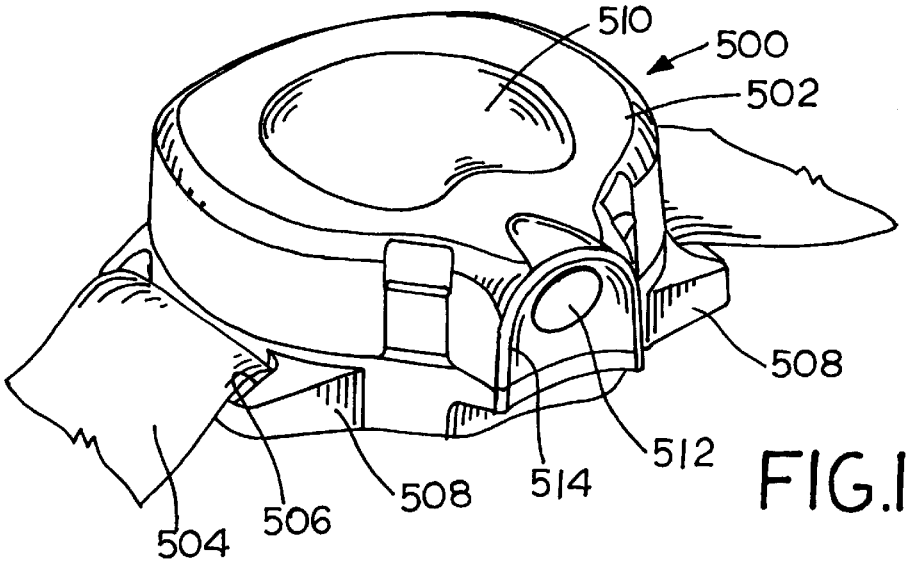
FIG. 12 is perspective view of a parent dual IR/RF badge in accordance with a preferred embodiment of the invention.

Referring now to FIGS. 12–14, a parent badge 500 in accordance with a preferred embodiment of the invention is shown. Parent badge 500 includes a housing 502 adapted to be secured to a strap 504 via a pair of apertures 506 formed in outwardly extending flanges 508. Formed in a center portion of housing 502 is a lens 510 formed from an IR transparent plastic. Along an edge of housing 502 is a push-button 512, which is offset within a shroud 514. Strap 504 is preferably removable from housing 502, and is further preferably arranged for single use and destructive removal.

Referring particularly to FIG. 14, disposed within housing 502 is a transmitter 516 according to a preferred embodiment of the invention. Transmitter 516 is arranged to provide both RF identification signal 36 and IR identification signal 34. It is further sized such that it may be disposed in any of housings 102, 202, 302 and 402 of the preferred infant badges 100, 200, 300 and 400, respectively, as well as within housing 502 of a parent badge. Push-button 512 couples through housing 502 and engages a momentary switch formed as part of transmitter 516.

Still referring to FIG. 14, housing 502 preferably includes a lower molded plastic member 518. Lens 510 may then form an upper portion of housing 502 and accordingly include a downwardly extending flange 520 extending about a circumference thereof and engaging a surface 522 of member 518. Lens 510 is either sonically welded, bonded or otherwise secured to member 518. Member 518 further includes a flange 524 upon which a portion of a printed circuit board (PCB) 526 of transmitter 516 is disposed and secured. Flange 524 forms a cavity 528 into which a battery 530 retained, and transmitter 516 is positioned above battery 530 with a second PCB 532 in operable engagement therewith.

Figure 16:
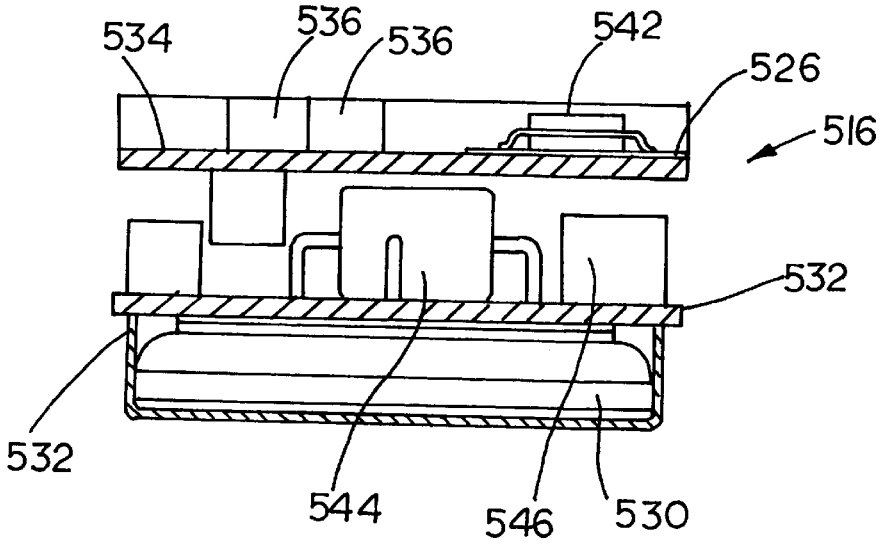
FIG. 16 is a side elevation view of the electronics package illustrated in FIG. 15.
Figure 15:
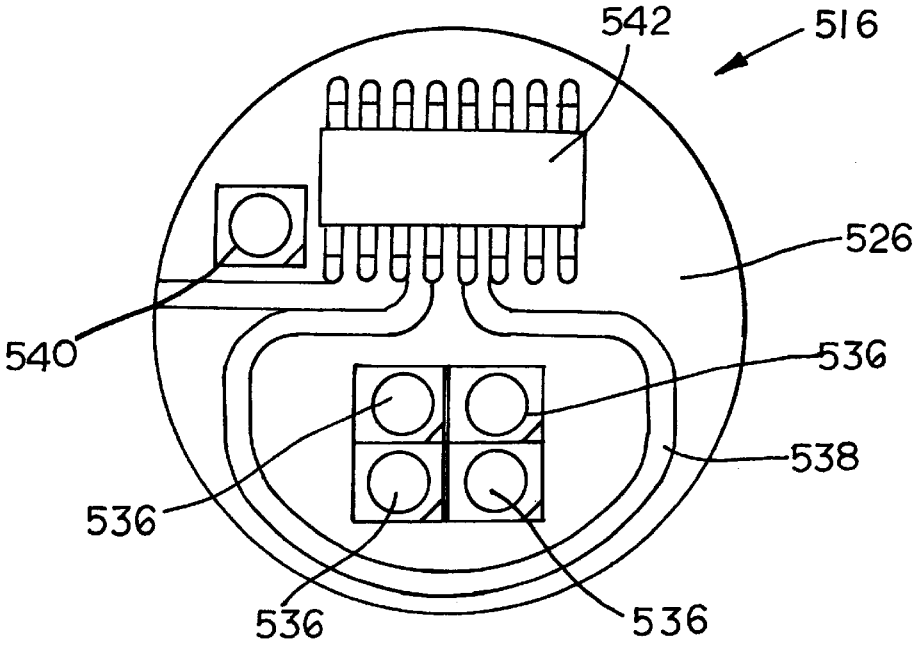
FIG. 15 is a plan view of a preferred electronics package for use in either the infant dual IR/RF badge or the parent dual IR/RF badge.
Figure 17:
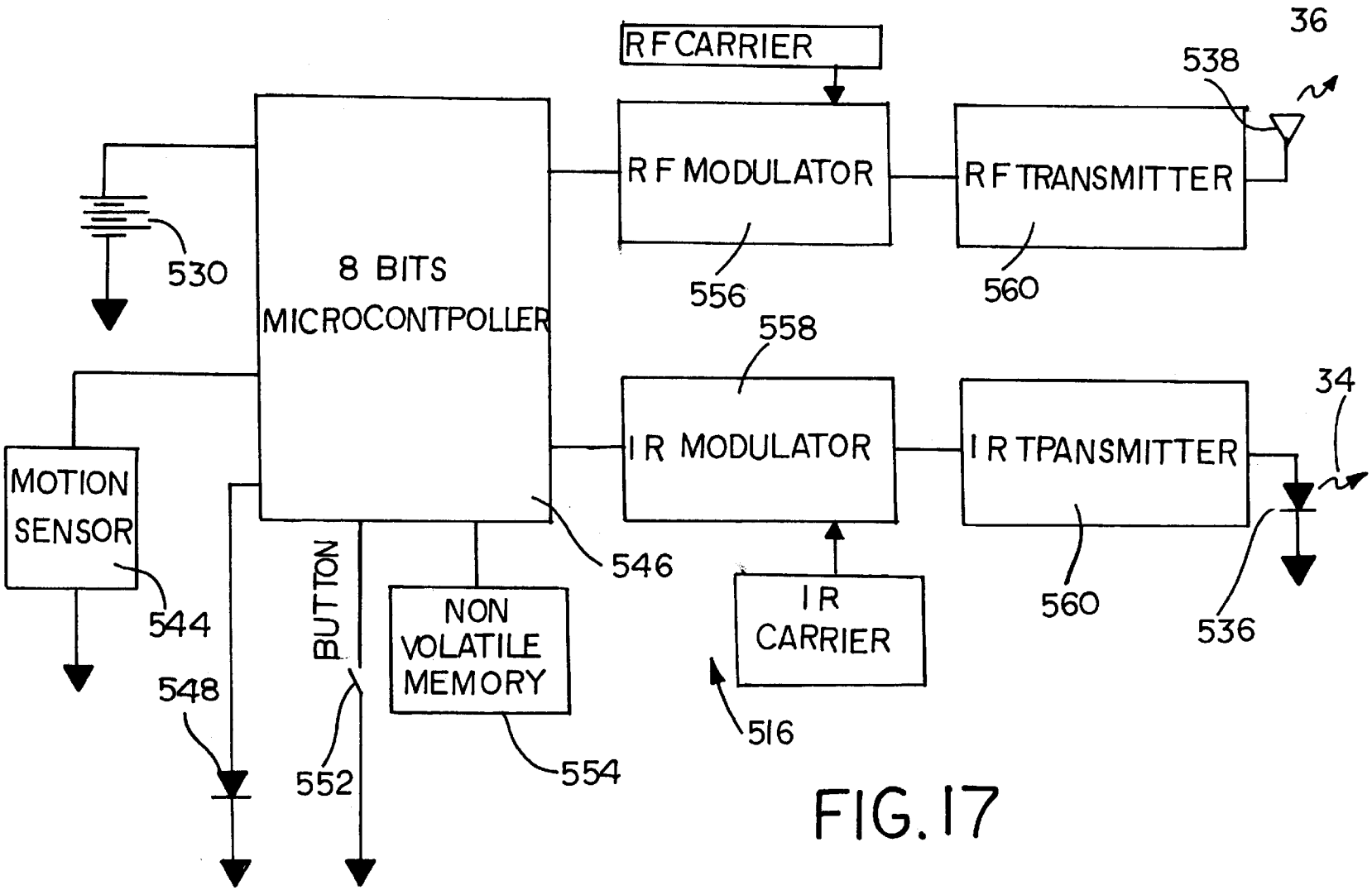
FIG. 17 is a block diagram illustrating the operative elements of a dual IR/RF badge in accordance with the invention.
Figure 17A:
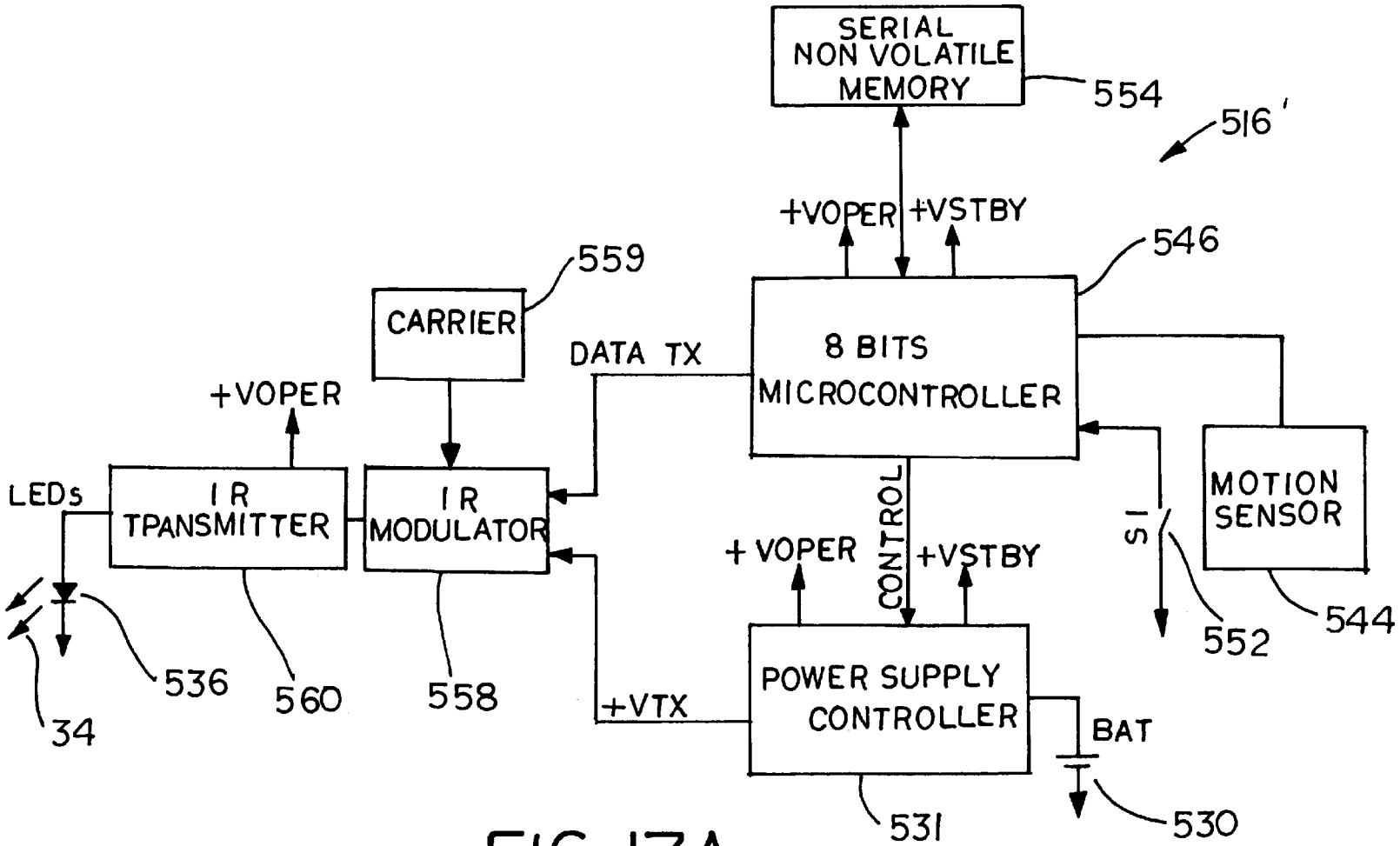
FIG. 17*a* is a block diagram illustrating the operative elements of an IR only badge in accordance with the invention.

Transmitter 516 is described in more detail now with reference to FIGS. 15–17. On an upper surface 534 of PCB 526 are a plurality of IR light emitting diodes (LEDs) 536, an RF antenna 538, a programming photo-diode 540 and a transmitter integrated circuit (IC) 542. LEDs 536, antenna 538, photo-diode 540 and IC 542 may be selected from commercially available components, and for example, LEDs 536 and photo-diode 540 are available from Siemens while IC 542 is available from Temic (part number U2740b). Transmitter 516 further includes coupled to PCB 532 a motion sensor 544, a microcontroller 546 and additional resistor, capacitor and diode components as is well-known in the art of circuit design. Microcontroller 546 may be a part number PIC12C5xx controller available from Microchip. Motion sensor 544 is preferably an electromechanical or piezo-type motion sensor. Battery 530 is preferably a 3.0 volt lithium battery and is commercially available from Renata. The actual layout and construction of PCB 526 and PCB 532 may be altered to accommodate different housing dimensions and applications, and thus, the transmitter 516 illustrated in FIGS. 14–16 is intended to be illustrative only of a potential layout. In this regard, FIG. 17 shows transmitter 516 in block diagram form to provide further understanding of the operative coupling of its functional elements, while FIG. 17*a* illustrates an IR only transmitter 516'similar in construction to transmitter 516 without RF transmission capability. Like reference numerals identify like elements between transmitters 516 and 516'.

Battery 530 and motion sensor 544 are coupled to microcontroller 546, which, in turn, is coupled to LED 548, momentary switch 552 (which is actuated by push button 512), and a non-volatile memory 554. LED 548 provides a very precise voltage reference, and may be used to perform contactless programming wherein LED 548 acts as a photodetector to receive programming signals. Outputs from microcontroller 546 are coupled to an RF modulator 556 and an IR modulator 558. RF modulator 556 is further coupled to an RF transmitter 560 and then to antenna 538. RF modulator 556 and RF transmitter 560 are preferably integrated into IC 542. As noted, a preferred IR modulation technique is on-off keying (OOK) modulation, and thus IR modulator 558 may be implemented as a switching device. IR modulator 558 is then coupled to an IR transmitter 560 and then to IR LEDs 536.

Figure 18:
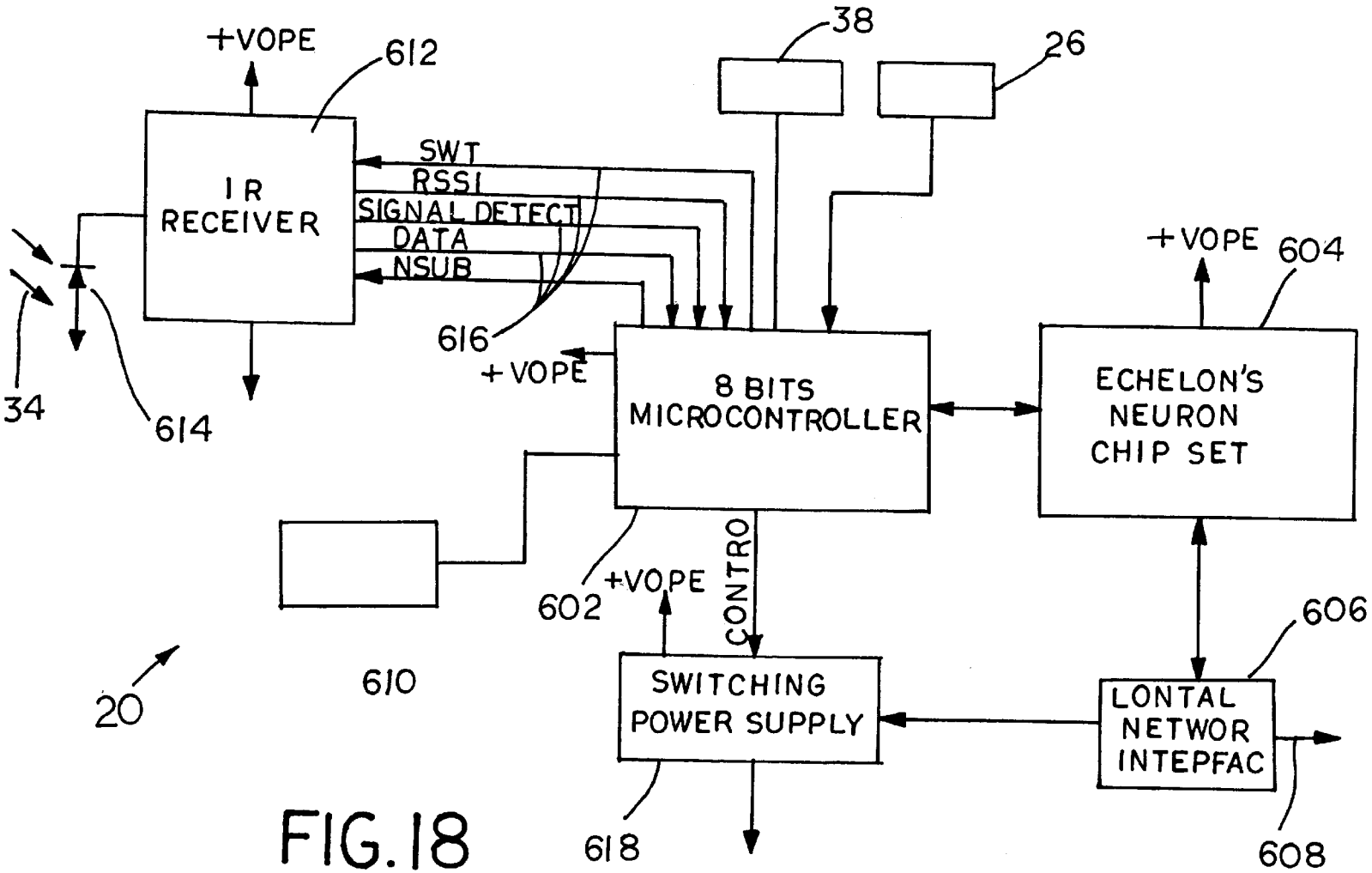
FIG. 18 is a block diagram illustrating an IR receiver in accordance with the invention.

As shown in FIG. 18, each IR reader 20 includes a microcontroller 602 coupled to an Echelon Neuron chip 604 through which it couples to a LonTalk network interface 606 into network 22 via a twisted pair coupling 608. Microcontroller 602 is further coupled to a non-volatile memory 610, to an external device controller 26 (if installed) and to alert devices 38. Further coupled to microcontroller 602 is an IR receiver 612 which includes an IR photo-diode array 614 for receiving IR identification signals 34. A switching power supply is also provided operatively coupled to the respective elements of IR reader 20. IR receiver 612 provides to microcontroller 602 at least a signal detect indication, a signal strength indication and a data signal via parallel bus 616.

Figure 19:
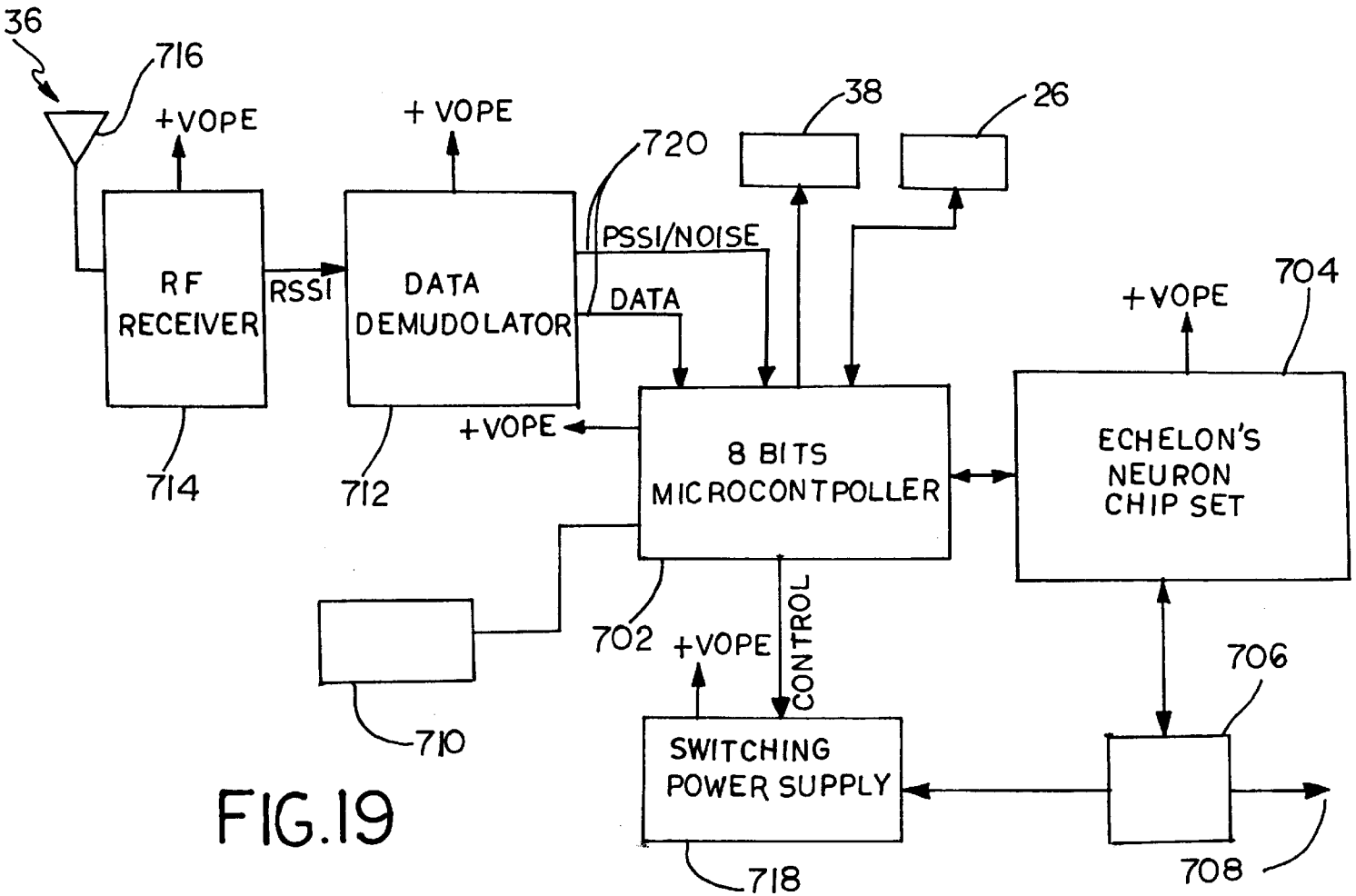
FIG. 19 is a block diagram illustrating an RF receiver in accordance with the invention.

As shown in FIG. 19, each RF reader 21 includes a microcontroller 702 coupled to an Echelon Neuron chip 704 through which it couples to a LonTalk network interface 706 into network 22 via a twisted pair coupling 708. Microcontroller 702 is further coupled to a non-volatile memory 710, to an external device controller 26 (if installed) and to alert 38. Further coupled to microcontroller 702 is a data demodulator 712 coupled to an RF receiver 714 which is coupled to an antenna 716 for receiving RF identification signals 36. A switching power supply 718 is also provided operatively coupled to the respective elements of RF reader 21. RF identification signals are received by RF receiver 714 and demodulated by data demodulator 712. Demodulator 712 provides to microcontroller 702 at least a signal strength indication and a data signal via parallel bus 720. Virtually any RF modulation scheme may be employed, and in a preferred embodiment amplitude shift keying (ASK) modulation is utilized. As should be appreciated from the foregoing discussion a single IR/RF reader may be constructed owing to the substantial reuse of components.

Figure 20:
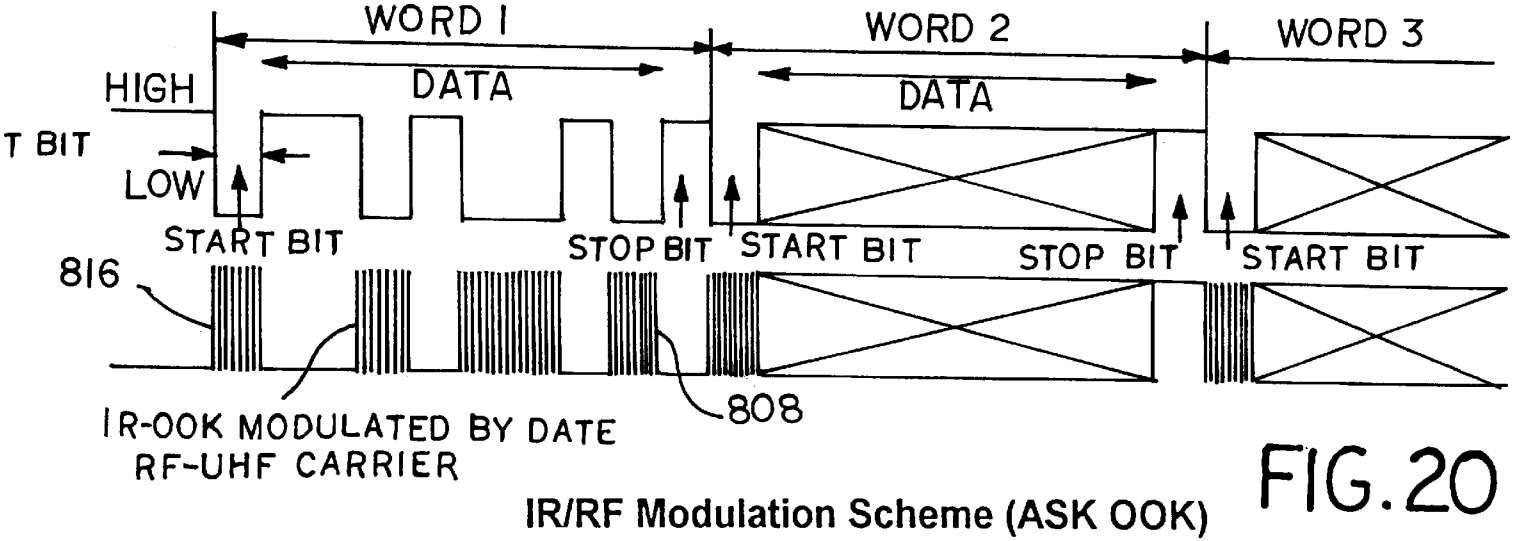
FIG. 20 is a diagram illustrating a communication modulation scheme in accordance with a preferred embodiment of the invention.
Figure 21:
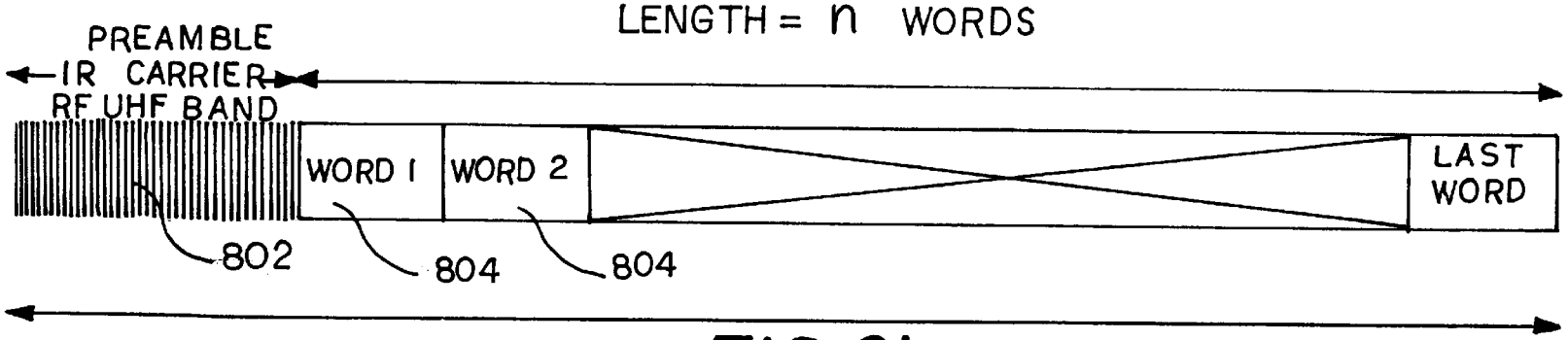
FIG. 21 is a diagram illustrating a data transmission protocol in accordance with a preferred embodiment of the invention.

Referring to FIGS. 20 and 21, each transmission, whether IR and OOK modulated or RF and ASK modulated, comprises a preamble portion 802 followed by a plurality of data words 804. Between 4 and 31 data words may be sent in a transmission. Each data word is identified by a start bit 806, and is concluded with a stop bit 808. The modulation illustrated is OOK for the IR transmissions. RF data is transmitted with a preferred modulation, such as ASK modulation, and the RF data is preferably distinguished based upon the preamble data. This advantageously allows the receiver circuitry following the signal reception and demodulation portions to be made common.

Figures 22A, 22B, 22C, 22D:
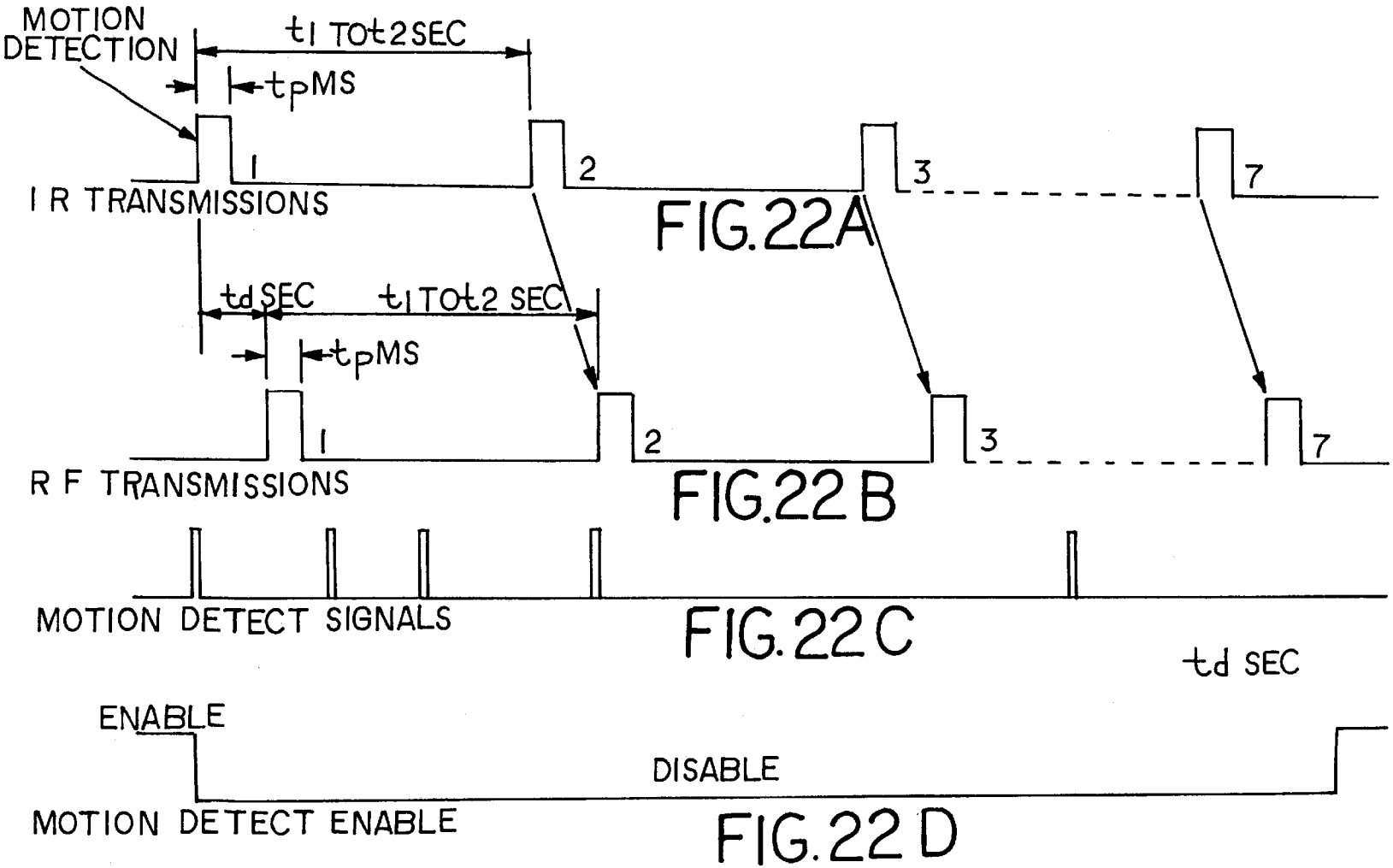
FIGS. 22*a*–22*d* are timing diagrams illustrating data transmission in a first operative state and in accordance with a preferred embodiment of the invention.

With reference now to FIGS. 22*a*–22*d,* to provide statistical signal separation of the RF identification signals 36 and the IR identification signals 34, and to hence reduce interference created by a plurality of either parent badges 30 or infant badges 32 operating in one area, motion sensor 544 is used to initiate transmission of signals 34 and 36. In FIG. 22*a,* a motion detect flag is enabled, and the badge controller 546 operates in a motion detect mode. The output of the motion sensor 544 is monitored, and upon receiving a motion detect signal from motion detector 544, FIG. 22*b,* the motion detect flag is disabled. Transmission of IR identification signal 34 is initiated. As shown in FIG. 22*d,* IR identification signal may be sent in a $t_p$ ms (preferably about 2 ms) burst approximately every $t_1$ to $t_2$ seconds (preferably about 3 to 5 seconds). Following transmission of IR identification signal 34 by a delay period $t_d$ (preferably about 4 ms), transmission of RF identification signal 36 is initiated, FIG. 22*c*. Similarly, RF identification signal 36 is preferably a $t_p$ ms burst signal, and it is transmitted timed to the transmission of IR identification signal 34. Most preferably, each of IR identification signal 34 and RF identification signal 36 contain the same data identified by a preamble message. After transmission of n bursts (preferably about 7), the motion detect enable signal is reset high, and the cycle is repeated upon once again detecting a motion disable signal.

As noted, by initiating transmission based upon a signal from motion detector 544 randomness is introduced to the signaling process. Moreover, the period for transmitting the signals is randomly varied from between 3–5 seconds. This provides substantial statistical separation allowing use of common IR and RF carriers without interference. A preferred IR carrier is 455 kHz, while a preferred RF carrier is in the ultra-high frequency (UHF) spectrum.

Figures 23A, 23B, 23C:
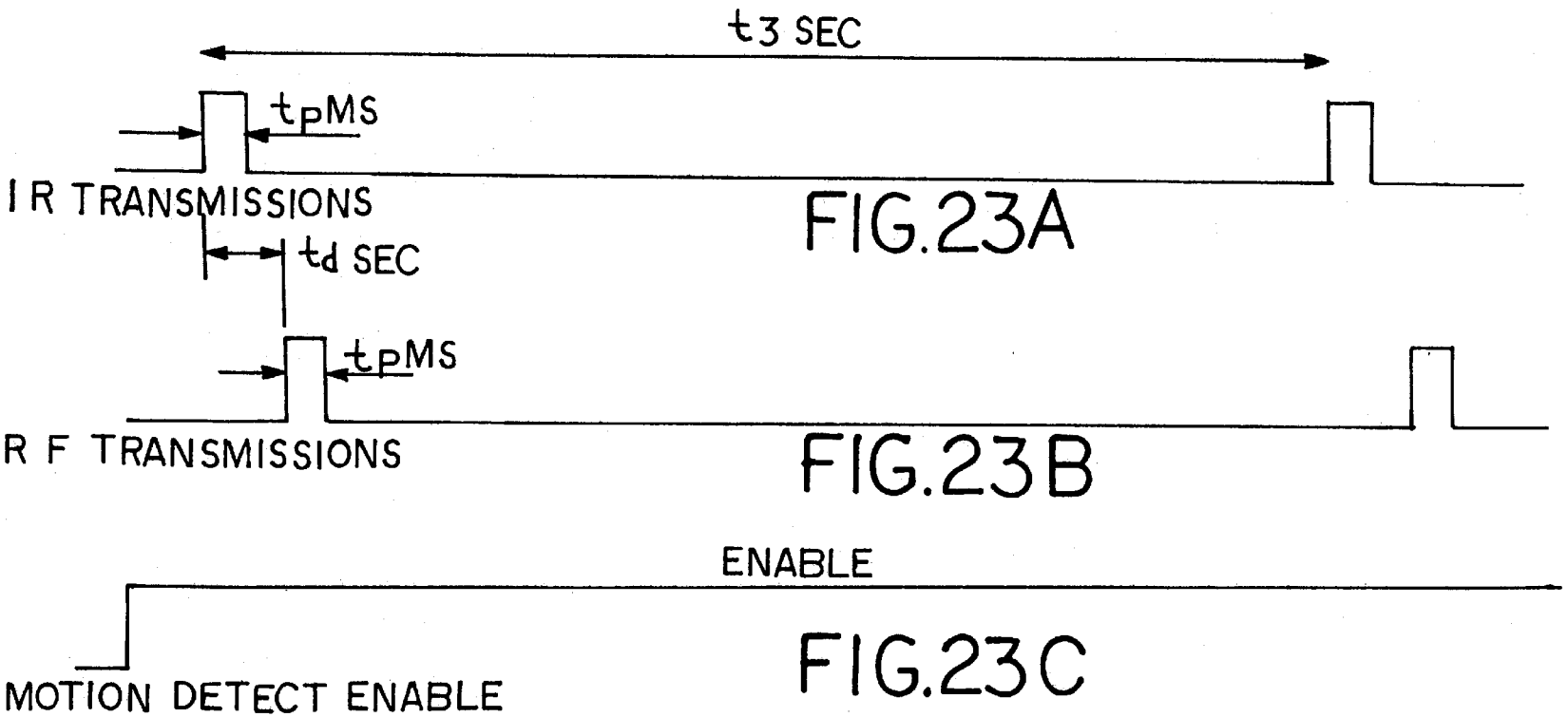
FIGS. 23*a*–23*c* are timing diagrams illustrating data transmission in a third operative state and in accordance with the invention.

FIGS. 23*a*–23*c* illustrate operation with the motion detect enable signal high. After a random period following a motion detect enable signal, an IR transmission of the IR identification signal 34 is initiated. As before, following a fixed time period after signal 34, RF transmission of the RF identification signal 36 is initiated. Now, however, a delay 60 of seconds occurs before the IR identification signal 34 and RF identification signal 36 are resent. This operation further reduces mutual interference by reducing the number of transmissions and by also introducing randomness to the transmissions as described above.

Figure 24:
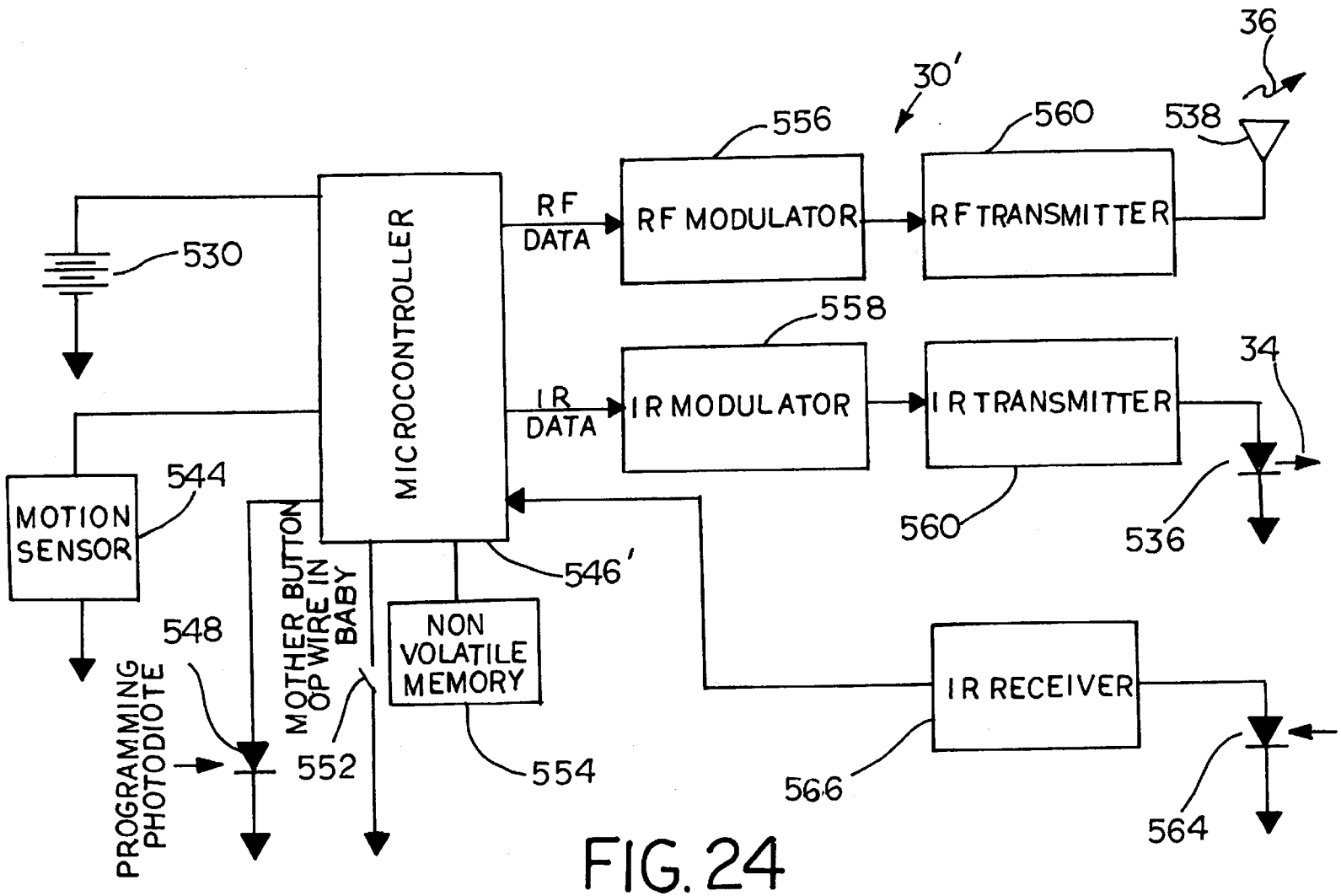
FIG. 24 is a block diagram illustrating operative elements that may be adapted to either a parent badge or an infant badge in accordance with an alternate embodiment of the invention.
Figure 25:
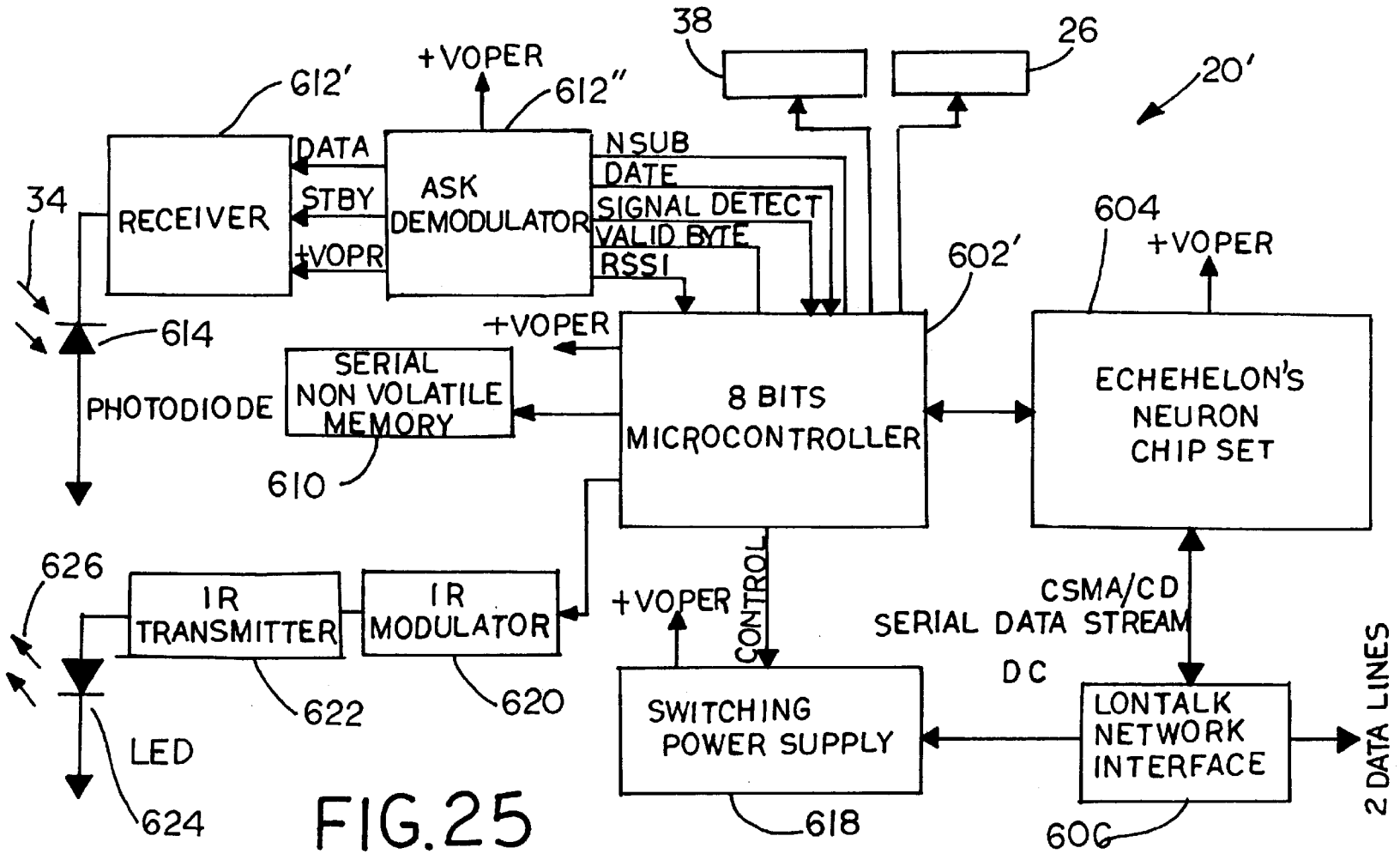
FIG. 25 is a block diagram illustrating operative elements that may adapted to an IR reader in accordance with an alternate embodiment of the invention.
Figures 26A, 26B, 26C, 26D, 26E, 26F:
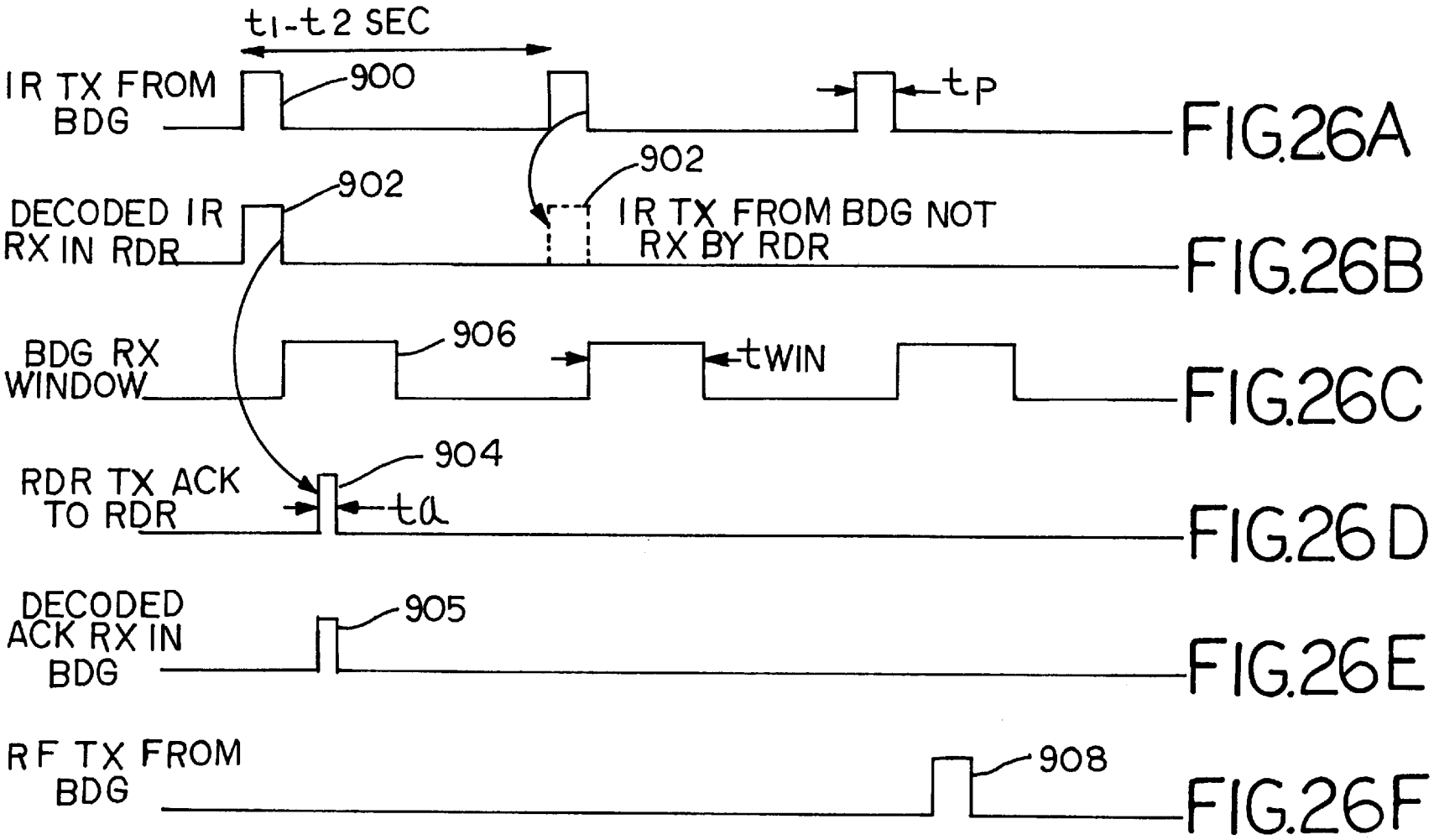
FIGS. 26*a*–26*f* are timing diagrams illustrating data transmission in a parent/infant matching and security system utilizing parent badges and infant badges shown in FIG. 24.

As will be appreciated, the invention allows, by randomly separating transmissions and keeping transmissions confined to short bursts as described, a large number of badges to operate within ward 10 without mutual interference. Referring to FIG. 24, the number of IR and RF transmissions may be further reduced by providing a modified mother badge 30' (an infant badge 32 may be similarly configured) with an IR detector 564 coupled to an IR receiver 566, which provides an IR detection signal to controller 546' adapted to receive and process the received signal and to generate a response thereto as described below. Mother badge 30' is as otherwise discussed with respect to mother badge 30 and like reference numerals are used to identify like elements. Mother badge 30' is operable in conjunction with IR receiver 20' (FIG. 25). IR receiver 20' is similar in construction to IR receiver 20, and like elements are identified with like reference numerals. IR receiver 20' further includes an IR modulator 620 couple to controller 602', an IR transmitter 622 and a transmitting LED 624. Controller 602' is operable to generate an acknowledgment signal 626, as described below, that is transmitted via the IR modulator 620, IR transmitter 622 and transmitting LED 624. If the IR acknowledgment signal 626 is detected and decoded by mother badge 30' (or a properly configured infant badge 32), RF transmissions are suspended. If the acknowledgment signal is not received and decoded, then the mother badge 30' transmits both the IR and RF identification signals 34 and 36, respectively, as previously described.

Referring to FIGS. 26*a*–26*f*, and again discussing the operation of the mother badge 30' (the operation of a modified infant badge 32 being similar) is discussed in more detail. The mother badge 30' transmits IR signals 906 having a $t_p$ ms duration every $t_1$–$t_2$ seconds. The signals 900 are detected by the IR reader 20 and decoded as signals 902. The mother badge 30' listens for an acknowledgment 904, a pulse of $t_a$, during a listening window 906 of duration $t_{win}$. If the IR reader 20 successfully decodes the signals 902, the IR reader 20 transmits, using IR, an acknowledgment signal 904. The acknowledgment signal 904 is received by the mother badge 30' and decoded as signal 905, and in response thereto, mother badge 30' suspends transmission of the RF signals. Should the reader fail to decode the signals 902, for example signal 902' shown in phantom, or if the mother badge 30' fails to detect the acknowledgment signal 904, RF signals 908 are transmitted. By so reducing the number of RF transmissions, the likelihood of badges mutually interfering is greatly reduced. It will be appreciated that a similar strategy or suspending IR transmissions in favor of RF transmissions may be employed without departing from the fair scope of the present invention.

Figure 27:
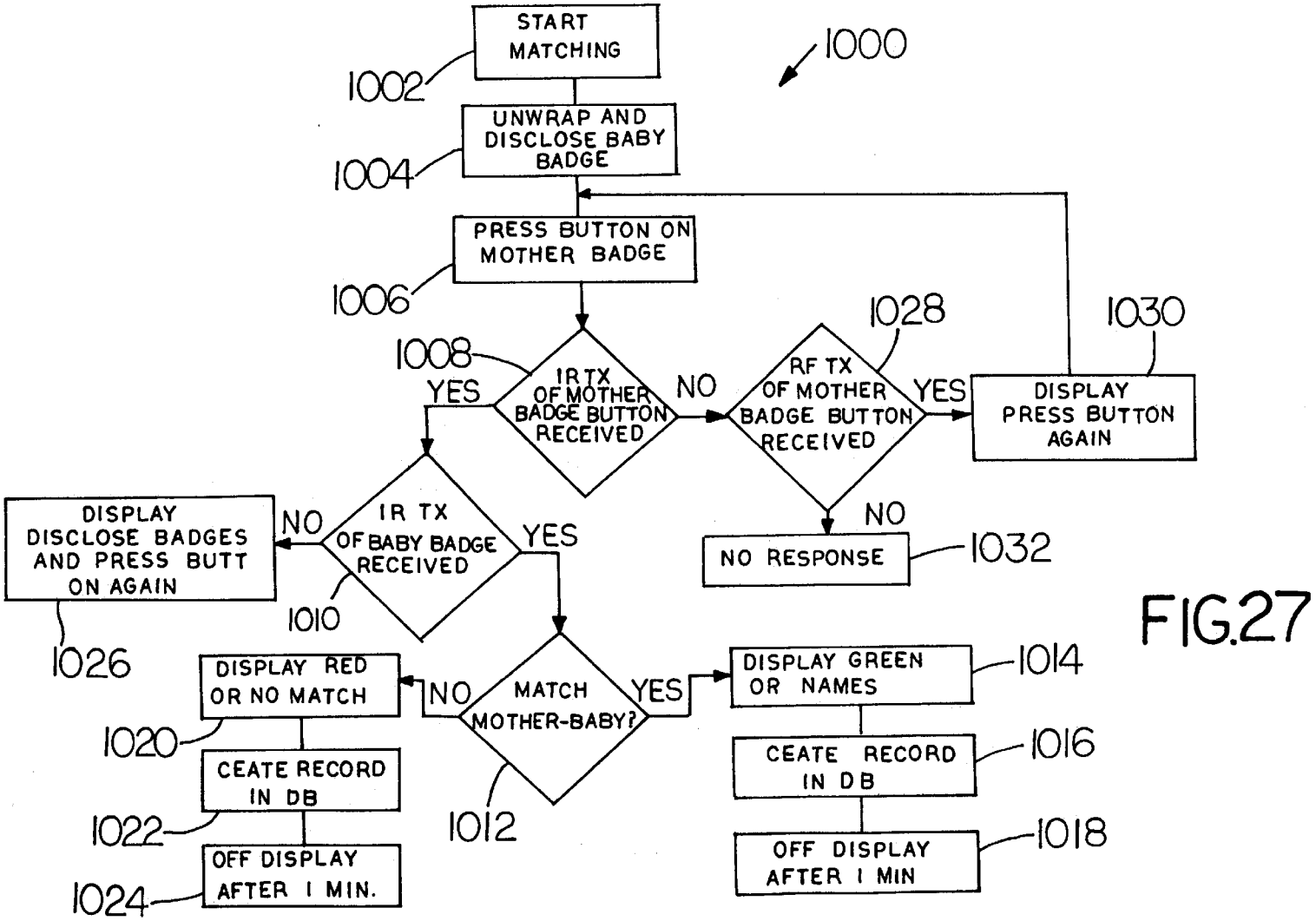
FIG. 27 is a flow chart illustrating a method of matching a parent with an infant in accordance with the invention.

The invention provides the capability of automatic or manual matching. Referring to FIG. 27, the manual matching process 1000 is initiated by the mother first unwrapping the infant to disclose the infant badge 32, step 1004, and pressing the push-button 552 provided with mother badge 30, step 1006. This initiates a matching process by transmitting the IR identification signal 34 and the RF identification signals 36. The identification data, as will be described more fully below, is preferably sent in a rapid succession of bursts followed by less frequent repeated bursts. This ensures immediate detection by the IR reader 20 located within the room with the mother. Upon detection of the mother's badge identification data, step 1008, the IR reader 20 then looks for and detects IR identification signals 34 from an infant badge 32 located within its range, step 1010. If the identification data in each of the signals matches, step 1012, display device 38 is caused to display appropriate matching data. Also, the database information is updated within server 24, step 1016, and after a period of time, such as about 1 minute, the display is turned off, step 1018. If the match fails, display device 38 displays the failed matching data, step 1020, such as flashing red, and indicating in text that a match has not taken place. Again, the database information is updated in server 24, step 1022, and after a predetermined period of time, such as about 1 minute, the display is turned off, step 1024. If the infant IR data is not detected, step 1010, the display may indicate to disclose the badges and repress the button 552 to restart the matching process, step 1026. If the mother badge 30 IR signals are not detected, step 1008, and the RF signals are also not detected, step 1028, there is no response. However, if the IR signals are not detected, step 1008, but the IR signals are detected, step 1028, then the display indicates that the button should be repressed to restart the matching process, step 1030.

An automatic process may also be implemented. In the automatic process, the mother's badge 30 transmits the IR identification data regularly in response to detected motion as described below. The matching process then continues as described.

As described, the strap 104 of the infant badges 32 contains a conductor 182. The conductor engages contacts 156 through operation of the strap coupling 108 to complete a loop. Upon detection of a completed loop, the transmitter becomes activated and begins transmitting. Most preferably, an initiation is accomplished with the system whereby information necessary to identify the badge is transmitted to the system and the database is automatically updated. Alternatively, a manual initiation process may be employed. The automatic process is preferred as it reduces the likelihood of introducing error.

The conductor 182 also provides an ability to detect tampering with the strap 104. Should the strap 104 be cut or the strap coupling 108 opened, the loop is broken. After activation if the loop is broken, an alert signal is transmitted with priority to indicate tampering. It is also possible to have the transmitter detect a resistance of the conductor 182. In this arrangement, a conductor having a resistance sensitive to strain would be used. Thus, if the strap 104 is stretched in order to remove the infant badge 32 from the infant, the change in resistance after activation can provide an indication of tampering and an alert signal may be sent. Most preferably, the conductor 182 is selected with a strength such that it will fail and open circuit should the strap 104 be stretched excessively.

Figures 28A, 28B, 28C, 28D:
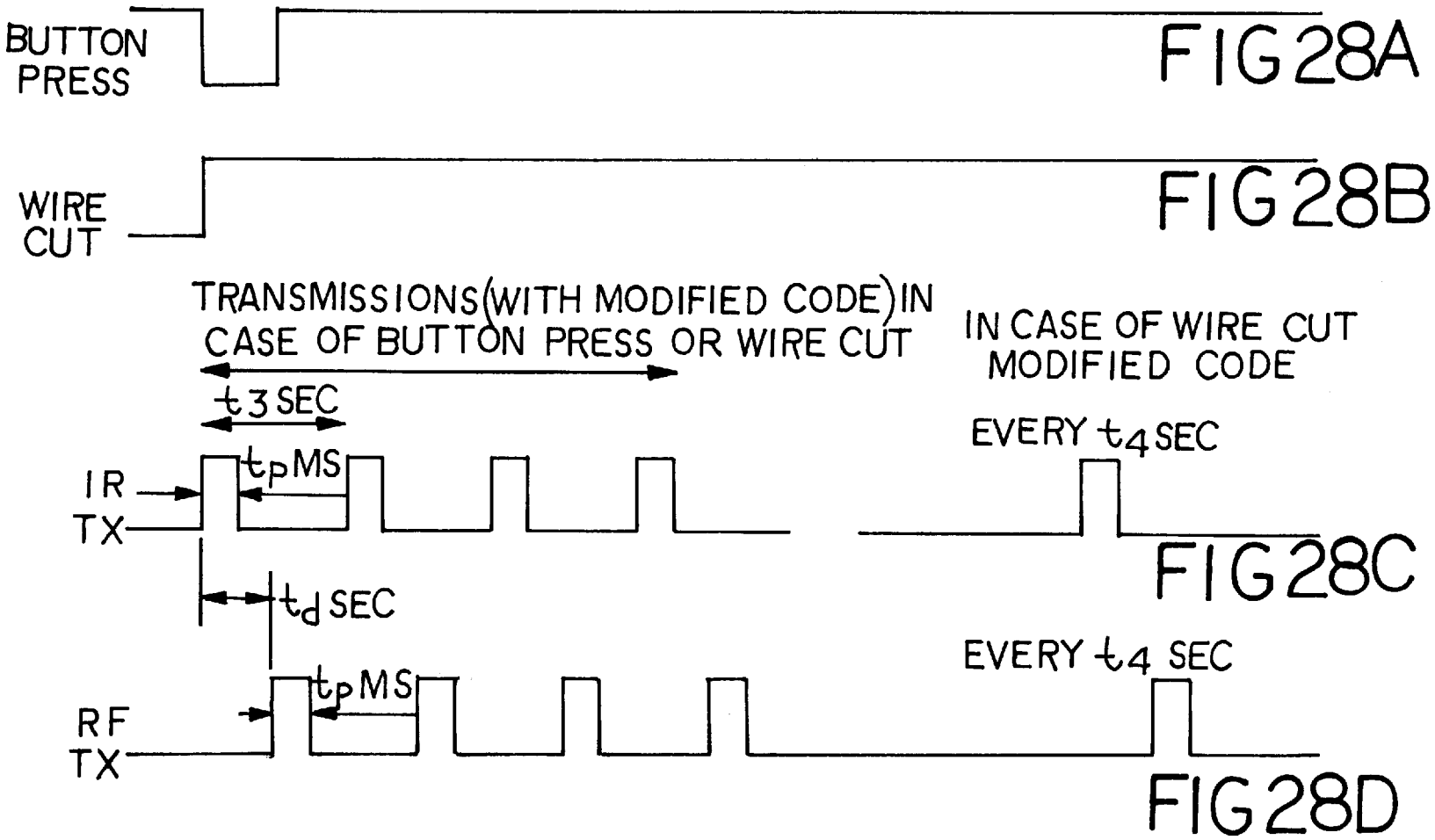
FIGS. 28*a*–28*d* are timing diagrams illustrating data transmission in a second operative state and in accordance with a preferred embodiment of the invention.

Referring to FIGS. 28*a*–28*d*, signal transmission during either of the manually initiated matching process and/or should the infant badge 32 strap 104 be tampered with is illustrated. As shown in FIG. 28*a*, a button pulse 1102 is detected or as shown in FIG. 28*b* a wire cut signal is pulled high 1103, and in response thereto, a rapid series of data pulses 1104 are transmitted. For example, as shown in FIGS. 28*c* and 28*d*, 4 IR pulses may be sent in series, where each signal is a pulse of duration $t_p$ transmitted every $t_3$ seconds. As described above, 4 RF pulses, timed to the IR pulses, may also be sent in series following respective ones of the IR pulses. If the pulse series is initiated as the result of the infant badge 32 strap 104 being cut or tampered with, a pulse 1106 is then sent every $t_4$ seconds (approximately every 3–5 seconds).

Several alert signals of differing priority are contemplated by the invention. For example, a soft alert may be provided where an infant is removed from nursery. It would be common for the infant to be moved from the nursery to the mother's recover room or to other parts of the maternity ward. If the infant is removed from the maternity ward, a higher level alert may be initiated. The soft alerts may be identified only at the server 24, and may be overridden by a user having the appropriate authority.

Higher level alerts may be used for instances where the infant is not matched with the correct parents. Matching is determined, as discussed, by decoding and comparing the IR identification signals. Also, if the infant is brought near an exit of the maternity ward or hospital, a high level alert would also be employed, and preferably an alert is sent to the hospital security staff via the hospital security system. Of course it will be appreciated that numerous alert levels and occurrences triggering such alerts may be employed with the invention without departing from its fair scope.

Figure 29:
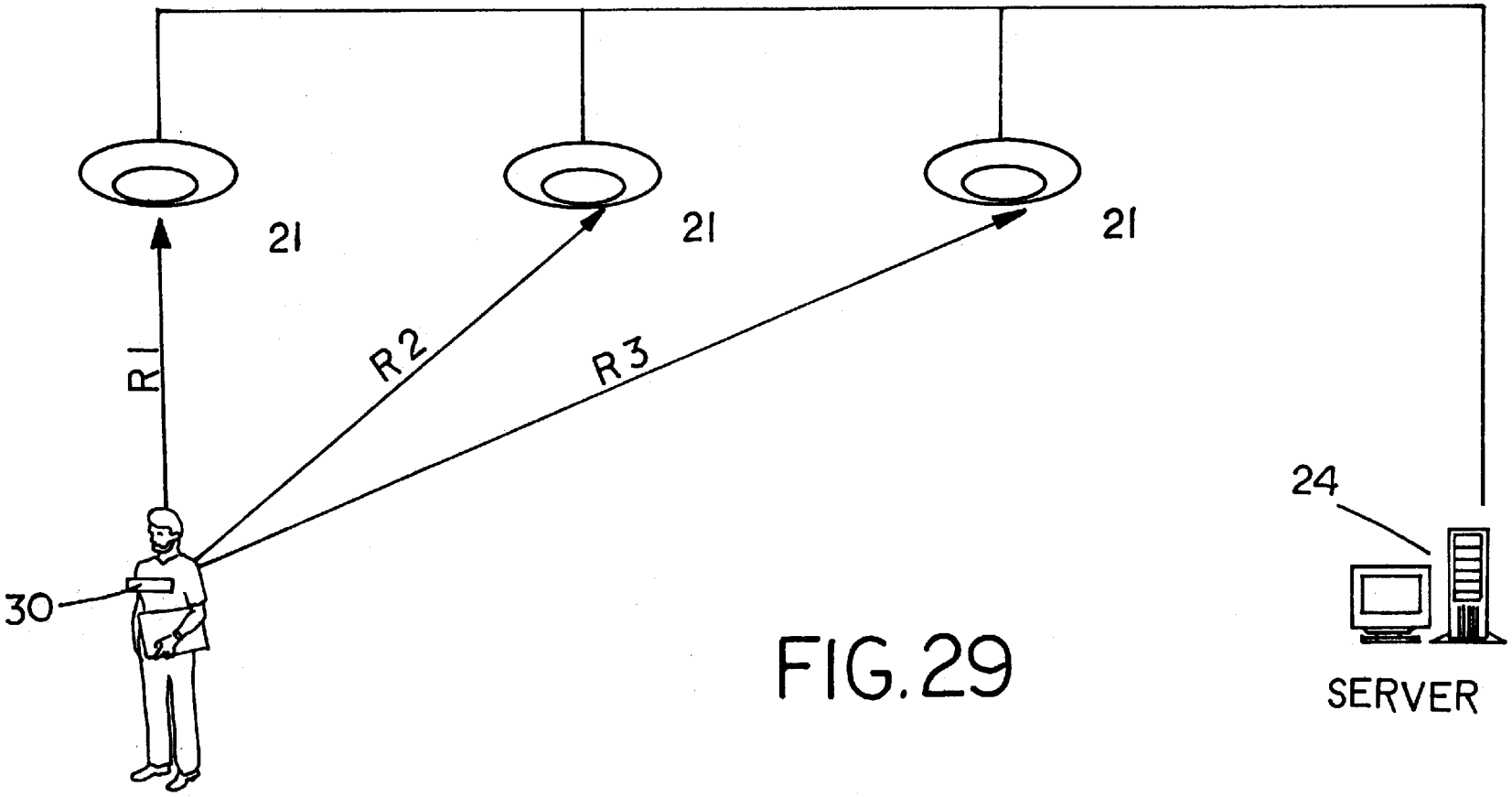
FIG. 29 is a diagram illustrating an alternate method for location determination in accordance with the invention.

Referring to FIG. 29, while it is noted that RF transmissions do not provide accurate location data, it is possible to use RSSI data to provide indications of location. The RF identification signals are transmitted with very low power, and preferably about −20 dbm, or 0.00001 watt. Thus, even though these signals will penetrate opaque, non-conducting surfaces they do not travel far. This short range may be used to detect that a badge has been moved away from a first RF reader and nearer to a second RF reader 21. Change of location is established only when the difference between the RSSI level of a received signal is more than a predetermined number of units from the RSSI level in the present location. For each received signal, that is for each badge, the signal sent from the reader 21 to the server 24 has attached the RSSI signal level and a noise level as received at the receiver. The server 24 may then use this data to provide location detection when the badge RF signals are received at several different readers. In addition, strategic location of RF readers within the hospital 1 can ensure a sufficient change in RSSI levels as a badge is brought near an exit of the ward 10 or hospital 1 for providing security. Upon detecting an infant badge 32 near an exit, for example, without approval an alarm condition is created.

Figure 30:
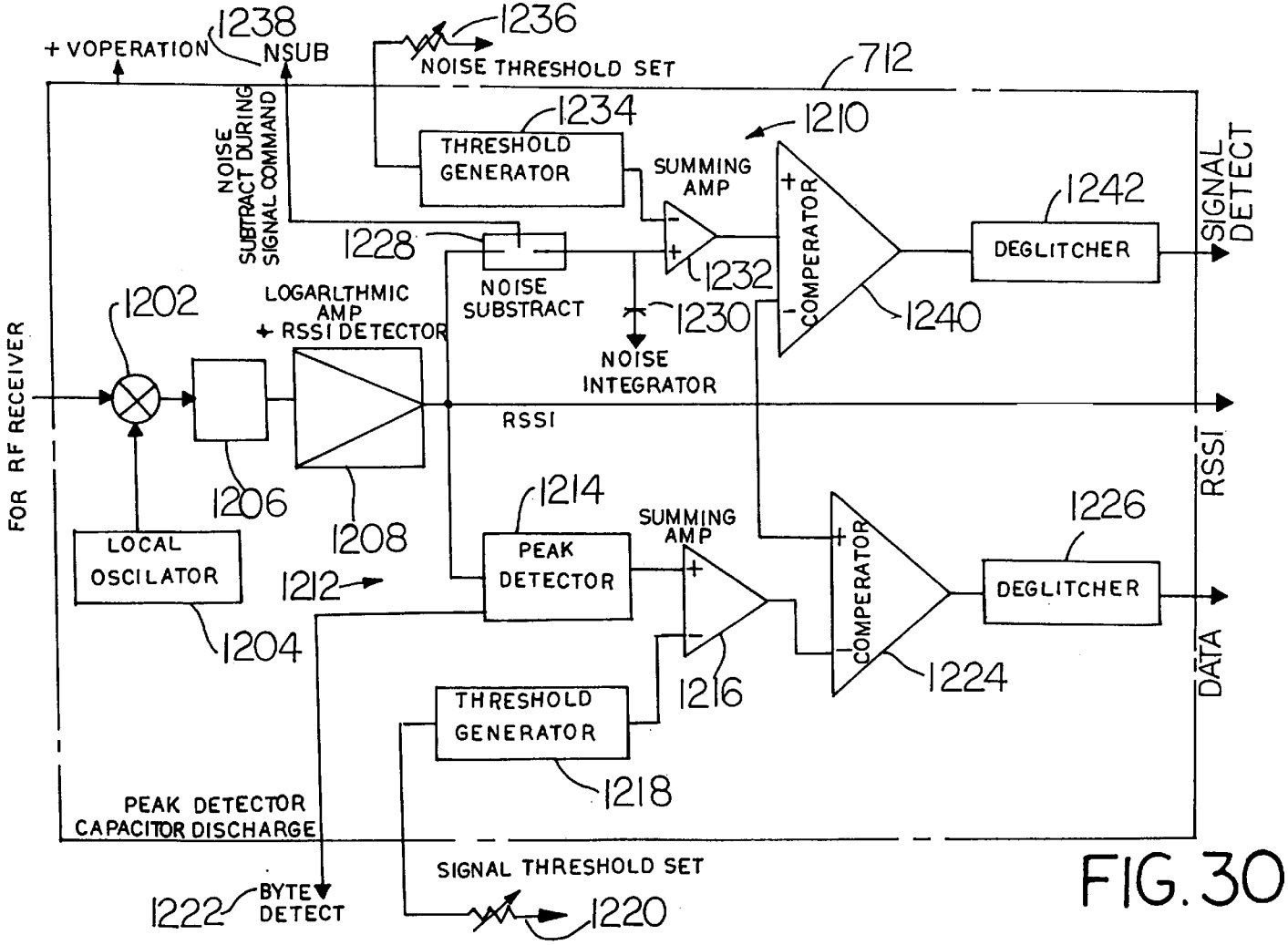
FIG. 30 is a block diagram illustrating an RF signal detection circuit in accordance with the invention.

In this regard, and with reference to FIGS. 29 and 30, the data demodulator 712 of the RF reader 21 is constructed to provide RSSI signal level detection and noise level in addition to providing the demodulated data. A frequency mixer 1202 is coupled to a local oscillator 1204 that down mixes the received RF signal from radio frequency to an intermediate frequency. The intermediate frequency signal is band pass filtered in filter 1206 and then coupled to an RSSI detector 1208 which determines the RSSI level and provides an RSSI signal level. The intermediate frequency is also coupled to an active noise circuit 1210 and to a data detect circuit 1212.

Data detect circuit 1212 includes an envelope detector 1214 an output of which is coupled to a summing amplifier 1216. A second input of the summing amplifier 1216 is coupled to a threshold generator 1218 which has an adjustable threshold setting 1220. Envelope detector 1214 further includes a byte detect line 1222. The output data is squared up through comparator 1224 and passed through deglitcher 1226.

Figure 31:
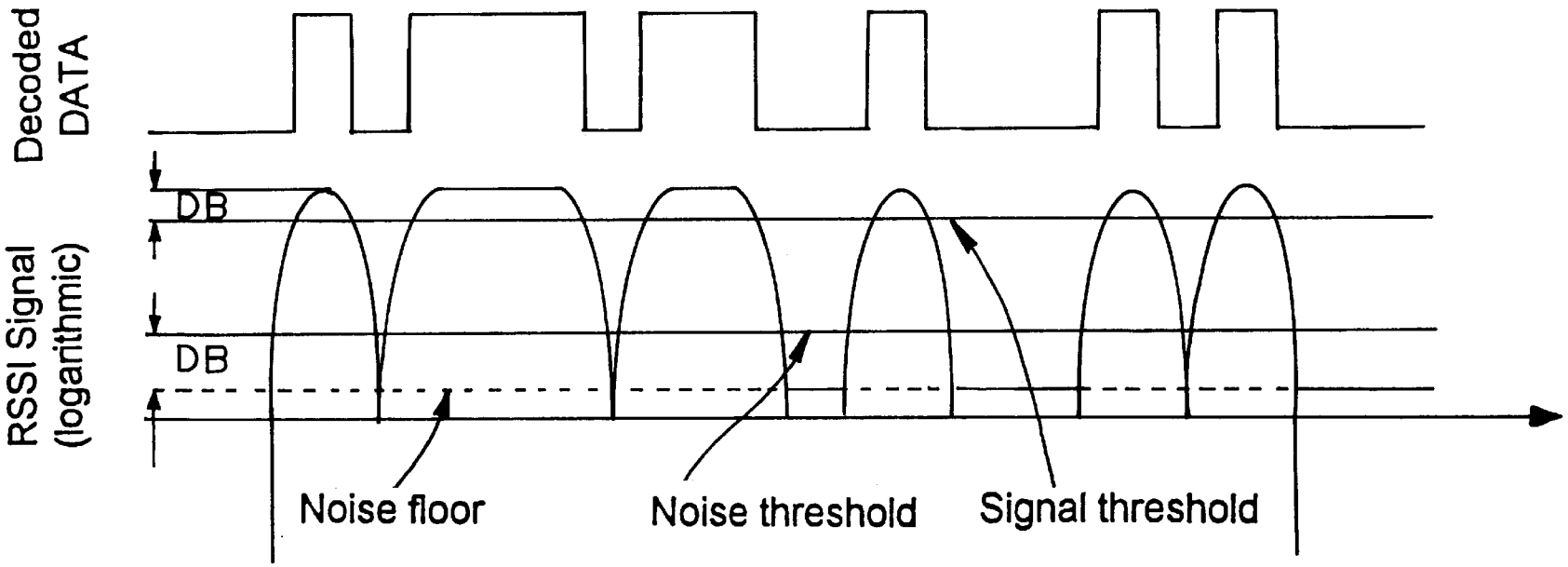
FIG. 31 illustrates data detection in accordance with the invention.

Active noise circuit 1210 includes a noise subtraction switch 1228 coupled to a noise subtract control line 1238. Circuit 1210 includes a noise integrator 1230 which is coupled to a summing amplifier 1232 that has a second input coupled to an output of a threshold generator 1234 and thus to an adjustable noise threshold 1236. An output of the summing amplifier 1232 is coupled through a comparator 1240 and passed through deglitcher 1242 to provide noise signal level. Operation of demodulator 712 to detect data, RSSI level and noise level is illustrated in FIG. 31.

The invention has been described in terms of several preferred embodiments. These descriptions should not, however, be taken as limiting as those of skill in the art will appreciate that the invention may otherwise be embodied without departing from the fair scope and spirit thereof. For example, the invention may be embodied in a system wherein equipment or devices, each including a badge constructed in accordance with the preferred embodiments of the invention, are matched with device users or other devices. The invention may also be embodied in a system apart from the described hospital environment without departing from its fair scope.

We claim:

1. A parent and infant matching and security system comprising:

a first transmitter adapted to be secured to a newborn infant, the first transmitter including a first radiant energy transmitter and a second radiant energy transmitter, each of the first radiant energy transmitter and the second radiant energy transmitter being operable to transmit an infant identification signal;

a second transmitter adapted to be secured to a parent of the newborn infant, the second transmitter including at least one radiant energy transmitter, the at least one radiant energy transmitter being operable to transmit a parent identification signal;

a plurality of receivers distributed at least within a maternity ward of a hospital, at least one of the plurality of receivers being operable to receive the infant identification signal and the parent identification signal, the at least one of the plurality of receivers being further operable to determine from the infant identification signal and the parent identification signal that the newborn infant is correctly matched with its parent; and wherein the plurality of receivers are arranged within the hospital to determine a continued presence of the infant within the maternity ward.

2. The parent and infant matching and security system of claim 1, wherein each of the plurality of receivers is coupled to a controller.

3. The parent and infant matching and security system of claim 1, wherein each of the plurality of receivers is coupled to an alarm signal generator, the alarm signal generator being operable to generate an alarm signal in response to the detection of an alarm condition.

4. The parent and infant matching and security system of claim 1, wherein the infant signal is a coded data signal.

5. The parent and infant matching and security system of claim 1, wherein the first radiant energy transmitter is operable to transmit the infant identification signal with a first modulation and the second radiant energy transmitter is operable to transmit the infant identification signal with a second modulation.

6. The parent and infant matching and security system of claim 1, wherein each of the first radiant energy transmitter and the second radiant energy transmitter comprise one of a radio-frequency transmitter and an infrared transmitter.

7. The parent and infant matching and security system of claim 1, wherein the at least one radiant energy transmitter comprises an infrared transmitter.

8. The parent and infant matching and security system of claim 1, wherein the second transmitter comprises at least a second radiant energy transmitter.

9. The parent and infant matching and security system of claim 8, wherein the at least a second radiant energy transmitter comprises one of a radio-frequency transmitter and an infrared transmitter.

10. The parent and infant matching and security system of claim 1, wherein each of the plurality of receivers are coupled to an in-hospital security system.

11. The parent and infant matching and security system of claim 1, wherein each of the plurality of receivers are coupled to a server.

12. The parent and infant matching and security system of claim 11, wherein the server comprises a database including a data structure, the data structure arranged to receive and retain infant identification data contained within the infant identification signal and parent identification data contained within the parent identification signal.

13. The parent and infant matching and security system of claim 12, wherein the server comprises a display, the display being coupled to the server and being operable to graphically display the infant identification data and the parent identification data.

14. The parent and infant matching and security system of claim 1, wherein the infant identification signal comprises infant identification data.

15. The parent and infant matching and security system of claim 1, wherein the parent identification signal comprises parent identification data.

16. The parent and infant matching and security system of claim 1, wherein each of the plurality of receivers comprises an infant/parent match indicator.

17. The parent and infant matching and security system of claim 1, wherein the first transmitter is contained within a housing and the housing includes an adjustable strap to secure the housing to the infant.

18. The parent and infant matching and security system of claim 17, wherein the housing is separable from the strap portion and reusable.

19. The parent and infant matching and security system of claim 18, wherein the housing is sealed to prevent the ingress of contaminants and to permit cleaning of an exterior portion.

20. The parent and infant matching and security system of claim 1, wherein the first transmitter comprises a motion detector, and wherein the first and second radiant transmitter are responsive to a signal from the motion detector for transmitting the infant identification signal.

21. The parent and infant matching and security system of claim 1, wherein the second transmitter is contained within a housing and the housing includes an adjustable strap to secure the housing to the infant.

22. The parent and infant matching and security system of claim 1, wherein each of the plurality of receivers is coupled to a network.

23. The parent and infant matching and security system of claim 22, wherein the network comprises an Echelon network.

24. The parent and infant matching and security system of claim 22, wherein the network comprises an applications interface.

25. The parent and infant matching and security system of claim 22, wherein the network is coupled to an in-hospital securing security system.

26. The parent and infant matching and security system of claim 1, wherein each of the plurality of receivers is Internet protocol (IP) addressable.

27. The parent and infant matching and security system of claim 1, the system having at least a first mode of operation and a second mode of operation, wherein in the first mode of operation at least a first of the plurality of receivers detects each of the infant identification signal and the parent identification signal for determining a matching of an infant and a parent, and in a second mode of operation a second of the plurality of receivers detects the infant identification signal for determining a security of the infant.

28. The parent and infant matching and security system of claim 27, wherein the at least a first of the plurality of receivers receives infrared radiant energy transmissions.

29. The parent and infant matching and security system of claim 27, wherein the second of the plurality of receivers receives radio-frequency radiant energy transmissions.

30. The parent and infant matching and security system of claim 27, wherein the at least a first of the plurality of receivers includes an indicator, the indicator operable to provide an indication upon detection at the first receiver of matching infant identification data and parent identification data.

31. The parent and infant matching and security system of claim 30, wherein the indicator comprises an acknowledgment signal transmitted by the at least a first of the plurality of receivers, and wherein at least one of the infant badge and the parent badge comprise a receiver for receiving the acknowledgment signal.

32. The parent and infant matching and security system of claim 31, the at least one of the infant badge and the parent badge being operable to modify transmission of the infant identification signal and the parent identification signal, respectively, responsive to receipt of the acknowledgment signal.

33. The parent and infant matching and security system of claim 27, wherein the at least a first of the plurality of receivers is coupled to a server, and wherein the first receiver provides a signal to the server upon detection at the first receiver of matching infant identification data and parent identification data.

34. The parent and infant matching and security system of claim 27, wherein the second of the plurality of receivers is coupled to an in-hospital security system and wherein the second receiver provides a signal to the security system upon detection infant identification data without a secured area of the hospital.

35. A dual mode badge comprising:

a housing;

an adjustable strap secured to the housing;

a dual mode transmitter disposed within the housing, the dual mode transmitter operable to transmit a signal using a first radiant energy transmission and to transmit the signal using a second radiant energy transmission, wherein the signal comprises a coded identification data; and wherein the housing is separable from the strap and reusable.

36. The dual mode badge of claim 35, wherein the first and second radiant energy transmission comprises one of a radio-frequency transmission and an infrared transmission.

37. The dual mode badge of claim 35, wherein the first radiant energy transmission comprises a first modulation and the second radiant energy transmission comprises a second modulation.

38. The dual mode badge of claim 35, wherein the first radiant energy transmission and the second radiant energy transmission are sequentially transmitted.

39. The dual mode badge of claim 35, wherein the first radiant energy transmission comprises a first header portion and the second radiant energy transmission comprises a second header portion.

40. The dual mode badge of claim 35, further comprising a motion detector, and wherein the dual mode transmitter is operable to transmit the signal responsive to a signal from the motion detector.

41. The dual mode badge of claim 35, further comprising a strap coupling, the strap coupling engaged with the strap for securing the strap to the housing and operatively coupled to activate the transmitter upon securing the strap to the transmitter.

42. The dual mode badge of claim 35, the strap being secured through a strap coupling formed in an upper portion of the housing.

43. The dual mode badge of claim 42, the strap coupling separable from the housing and the housing being reusable.

44. The dual mode badge of claim 35, wherein the housing is environmentally sealed and cleanable.

45. An entity matching system comprising:

a first transmitter adapted to be secured to a first entity, the first transmitter including a first radiant energy transmitter and a second radiant energy transmitter, each of the first radiant energy transmitter and the second radiant energy transmitter being operable to transmit a first identification signal;

a second transmitter adapted to be secured to a second entity to be matched with the first entity, the second transmitter including at least one radiant energy transmitter, the at least one radiant energy transmitter being operable to transmit a second identification signal; and a plurality of receivers distributed at least within a matching area, each of the plurality of receivers operable to receive the first identification signal and the second identification signal, the plurality of receivers being further operable to determine from the first identification signal and the second identification signal that the first entity is correctly matched with the second entity.

46. The entity matching system of claim 45, wherein each of the plurality of receivers are coupled to a controller.

47. The entity matching system of claim 45, wherein the plurality of receivers are arranged within the matching area to detect the continued presence of at least the first entity within the matching area.

48. The entity matching system of claim 45, wherein each of the plurality of receivers are coupled to an alarm signal generator, the alarm signal generator being operable to generate an alarm signal in response to the detection of an alarm condition.

49. The entity matching system of claim 45, wherein the first identification signal is a coded data signal.

50. The entity matching system of claim 45, wherein each of the first radiant energy transmitter and the second radiant energy transmitter comprise one of a radio-frequency transmitter and an infrared transmitter.

51. The entity matching system of claim 45, wherein the at least one radiant energy transmitter comprises an infrared transmitter.

52. The entity matching system of claim 45, wherein the second energy transmitter comprises one of a radio-frequency transmitter and an infrared transmitter.

53. The entity matching system of claim 45, wherein the first transmitter comprises a motion detector, and wherein the first and second radiant energy transmitters are responsive to a signal from the motion detector for transmitting the first identification signal.

54. The entity matching system of claim 45, wherein each of the plurality of receivers is coupled to a network.

55. The entity matching system of claim 54, wherein the network comprises an Echelon network.

56. The entity matching system of claim 45, wherein each of the plurality of receivers is Internet protocol (IP) addressable.

57. The entity matching system of claim 45, wherein at least a first of the plurality of receivers receives infrared radiant energy transmissions and a second of the plurality of receivers receives radio-frequency radiant energy transmissions.

58. The entity matching system of claim 45, wherein at least one of the first transmitter and the second transmitter further comprises a receiver and wherein at least one of the plurality of receivers comprises a transmitter, the at least one of the plurality of receivers being operable to transmit an acknowledgment signal responsive to receipt of one of the first and second identification signals.

59. The entity matching system of claim 58, wherein the one of the first and second transmitters is operable to modify transmission of the first and second identification signals, respectively, responsive to the receipt of the acknowledgment signal.

60. An entity matching system comprising:

a first transmitter adapted to be secured to a first entity, the first transmitter including a first radiant energy transmitter, a second radiant energy transmitter and a first radiant energy receiver, each of the first radiant energy transmitter and the second radiant energy transmitter being operable to transmit a first identification signal and the first radiant energy receiver being operable to receive an acknowledgment signal;

a second transmitter adapted to be secured to a second entity to be matched with the first entity, the second transmitter including at least one radiant energy transmitter, the at least one radiant energy transmitter being operable to transmit a second identification signal;

a plurality of receivers distributed at least within a matching area, each of the plurality of receivers operable to receive the first identification signal and the second identification signal, the plurality of receivers being further operable to determine from the first identification signal and the second identification signal that the first entity is correctly matched with the second entity; and at least one of the plurality of receivers comprising a transmitter, the at least one of the plurality of receivers adapted to transmit the acknowledgment signal responsive to receipt of one of the first identification signal.

61. The entity matching system of claim 60, wherein absent receipt of the acknowledgment signal, each of the first radiant energy transmitter and second radiant energy transmitter are operable to transmit the first identification signal.

62. The entity matching system of claim 60, wherein responsive to receipt of the acknowledgment signal, the first radiant energy transmitter is operable to transmit the first identification signal and the second radiant energy transmitter is disabled.

* * * * *